US007883587B2

(12) United States Patent
Nakamura et al.

(10) Patent No.: US 7,883,587 B2
(45) Date of Patent: Feb. 8, 2011

(54) METHOD FOR PREPARING RARE EARTH PERMANENT MAGNET

(75) Inventors: Hajime Nakamura, Echizen (JP); Koichi Hirota, Echizen (JP); Takehisa Minowa, Echizen (JP)

(73) Assignee: Shin-Etsu Chemical Co., Ltd., Tokyo (JP)

( * ) Notice: Subject to any disclaimer, the term of this patent is extended or adjusted under 35 U.S.C. 154(b) by 242 days.

(21) Appl. No.: 11/941,127

(22) Filed: Nov. 16, 2007

(65) Prior Publication Data

US 2008/0247898 A1 Oct. 9, 2008

(30) Foreign Application Priority Data

Nov. 17, 2006 (JP) ..... 2006-311352

(51) Int. Cl.
*H01F 1/057* (2006.01)
*H01F 1/053* (2006.01)

(52) U.S. Cl. ..... 148/122; 148/101; 148/301; 148/302

(58) Field of Classification Search ..... None
See application file for complete search history.

(56) References Cited

U.S. PATENT DOCUMENTS

| | | | | |
|---|---|---|---|---|
| 4,917,778 | A * | 4/1990 | Takada et al. | 205/181 |
| 5,034,146 | A | 7/1991 | Ohashi et al. | |
| 5,194,099 | A | 3/1993 | Esper et al. | |
| 5,405,455 | A | 4/1995 | Kusunoki et al. | |
| 5,411,603 | A | 5/1995 | Vial et al. | |
| 5,766,372 | A | 6/1998 | Fujimura et al. | |
| 5,858,123 | A * | 1/1999 | Uchida et al. | 148/302 |
| 5,858,124 | A * | 1/1999 | Endo et al. | 148/302 |
| 6,296,720 | B1 | 10/2001 | Yamamoto et al. | |
| 6,302,939 | B1 | 10/2001 | Rabin et al. | |
| 6,606,019 | B1 | 8/2003 | Ohashi | |
| 6,960,240 | B2 | 11/2005 | Hirota et al. | |
| 7,053,745 | B2 | 5/2006 | Yoshimura et al. | |

(Continued)

FOREIGN PATENT DOCUMENTS

EP 62-256412 A 11/1987

(Continued)

OTHER PUBLICATIONS

European Search Report dated Mar. 31, 2008, issued in corresponding European Patent No. 07254503.

(Continued)

*Primary Examiner*—John P Sheehan
(74) *Attorney, Agent, or Firm*—Westerman, Hattori, Daniels & Adrian, LLP

(57) ABSTRACT

A rare earth permanent magnet is prepared by providing a sintered magnet body consisting of 12-17 at % of rare earth, 3-15 at % of B, 0.01-11 at % of metal element, 0.1-4 at % of O, 0.05-3 at % of C, 0.01-1 at % of N, and the balance of Fe, disposing on a surface of the magnet body a powder comprising an oxide, fluoride and/or oxyfluoride of another rare earth, and heat treating the powder-covered magnet body at a temperature below the sintering temperature in vacuum or in an inert gas, for causing the other rare earth to be absorbed in the magnet body.

14 Claims, 1 Drawing Sheet

(a) (b)

U.S. PATENT DOCUMENTS

| | | | | |
|---|---|---|---|---|
| 7,485,193 | B2 | 2/2009 | Hirota et al. | |
| 2003/0047240 | A1 | 3/2003 | Honkura et al. | |
| 2004/0000359 | A1 | 1/2004 | Takikawa et al. | |
| 2004/0187970 | A1 | 9/2004 | Ishizaka et al. | |
| 2006/0213582 | A1 * | 9/2006 | Nakamura et al. | 148/302 |
| 2006/0278517 | A1 | 12/2006 | Machida et al. | |
| 2007/0017601 | A1 | 1/2007 | Miyata et al. | |
| 2007/0034299 | A1 | 2/2007 | Machida et al. | |
| 2007/0160863 | A1 | 7/2007 | Hamada et al. | |
| 2007/0240787 | A1 | 10/2007 | Nakamura et al. | |
| 2007/0240788 | A1 | 10/2007 | Nakamura et al. | |
| 2007/0240789 | A1 | 10/2007 | Nakamura et al. | |
| 2008/0223489 | A1 | 9/2008 | Nagata et al. | |
| 2008/0245442 | A1 | 10/2008 | Nakamura et al. | |
| 2008/0247898 | A1 | 10/2008 | Nakamura et al. | |
| 2009/0098006 | A1 | 4/2009 | Nakamura et al. | |
| 2009/0226339 | A1 | 9/2009 | Nakamura et al. | |

FOREIGN PATENT DOCUMENTS

| | | | |
|---|---|---|---|
| EP | 0255939 | A2 | 2/1988 |
| EP | 1643513 | A1 | 4/2006 |
| EP | 1705668 | A2 | 9/2006 |
| EP | 1705669 | A2 | 9/2006 |
| EP | 1705670 | A2 | 9/2006 |
| EP | 1705671 | A2 | 9/2006 |
| EP | 1734539 | A1 | 12/2006 |
| EP | 1 830 371 | A1 | 9/2007 |
| JP | 61-195954 | A | 8/1986 |
| JP | 1-117303 | A | 5/1989 |
| JP | 01-155603 | A | 6/1989 |
| JP | 1-251704 | A | 10/1989 |
| JP | 3-188241 | A | 8/1991 |
| JP | 4-184901 | A | 7/1992 |
| JP | 04-328204 | A | 11/1992 |
| JP | 4-328804 | A | 11/1992 |
| JP | 05-021218 | A | 1/1993 |
| JP | 6158238 | A | 6/1994 |
| JP | 06-244011 | A | 9/1994 |
| JP | 6-244011 | A1 | 9/1994 |
| JP | 2003-282312 | A | 10/2003 |
| JP | 3471876 | B2 | 12/2003 |
| JP | 2004-281492 | A | 10/2004 |
| JP | 2004-281493 | A | 10/2004 |
| JP | 2004-296973 | A | 10/2004 |
| JP | 2004-304038 | A | 10/2004 |
| JP | 2005-11973 | A | 1/2005 |
| JP | 2005-285861 | A | 10/2005 |
| JP | 2006-49865 | A | 2/2006 |
| JP | 2007-53351 | A | 3/2007 |
| RU | 2 136 068 | C1 | 8/1999 |
| SU | 1 513 738 | A1 | 4/1995 |
| WO | 2004-114333 | A1 | 12/2004 |
| WO | 2005-123974 | A1 | 12/2005 |
| WO | 2006-003882 | A1 | 1/2006 |
| WO | 2006/043348 | A1 | 4/2006 |
| WO | 2007-119551 | A1 | 10/2007 |

OTHER PUBLICATIONS

Hirota, K. et al.; "Coercivity Enhancement by the Grain Boundary Diffusion Process to Nd-Fe-B Sintered Magnets"; IEEE Transactions on Magnetics, vol. 42, No. 10, pp. 2909-2911, XP002463459, Oct. 2006.

K.D. Durst et al. "The Coercive Field of Sintered and Melt-Spun NdFeB Magnets," Journal of Magnetism and Magnetic Materials, 68 (1987); pp. 63-75.

International Search Report of PCT/JP2007/056594, date of mailing Jul. 10, 2007.

International Search Report of PCT/JP2007/056586, date of mailing Jun. 19, 2007.

"Shin-Etsu Chemical develops new high-performance technology for neodymium rare-earth magnets", Shin-Etsu News, press release in Tokyo, Mar. 24, 2005.

IEEE International Magnetics Conference, May 8-12, 2006, p. 910.

Digest of the 30th Annual Conference on MAGNETICS in Japan 2006, pp. 417-418.

European Search Report dated Jun. 4, 2008, issued in corresponding European Patent Application Number 07251603.2.

European Search Report dated Jun. 26, 2008, issued in corresponding European Patent Application Number 08250927.4.

Qin, C-D et al., "The protective coatings of NdFeB magnets by Al and Al(Fe)", Journal of Applied Physics, American Institute of Physics, 01.79, No. 8, pp. 4854-4856, Apr. 15, 1996.

Russian Decision on Grant dated Mar. 18, 2009, issued in corresponding Russian patent application No. 200611752902.

Kim, A.S. et al. "Development of High Coercive Powder From the Nd-Fe-B Sintered Magnet Scrap" IEEE Transactions on Magnetics, IEEE Service Center, New York, NY, US, vol. 40, No. 4, Jul. 2004, pp. 2877-2879. XP-011117004.

Extended European Search Report dated Jan. 14,2008 of European Application No. 06250542.5.

Machine Translation of JP 06-24401 I. Only Abstract translated.

The Journal of the Institute of Electrical Engineers of Japan, vol. 124, 2004, pp. 699-702, published on Nov. 1, 2004.

Intermag Asia 2005; Digest of the IEEE International Magnetics Conference; p. 476; held on Apr. 4-8, 2005.

Techno-Frontier Symposium 2005; pp. Bl-2-1 to Bl-2-12; held on Apr. 20, 2005 by JMA.

Nakamura, Hajime et al., "Magnetic Properties of Extremely Small Nd-Fe-B Sintered Magnets", IEEE Transactions on Magnetics, vol. 41, No. 10. Oct. 2005, pp. 3844-3846.

Abstract of Autumn Meeting of Japan Society of Powder and Powder Metallurgy, 2005; p. 143; held on Nov. 14-16, 2005.

2005 BM Symposium, Abstract of Presentation by the Japan Association of Bonded Magnet Industries held on Dec. 2, 2005.

Translation of International Preliminary Report on Patentability mailed May 3, 2007 of International Application No. PCT/JP2005/005134.

International Search Report of International Application No. PCT/JP2005/005 134, mailing date of Jul. 12, 2008.

K.T. Park et al.; "Effect of Metal-Coating and Consecutive Heat Treatment on Coercivity of Thin Nd-Fe-B Sintered Magnets", Proceedings of the Sixteenth International Workshop on Rare-Earth Magnets and Their Applications, Sendai, (2000) pp. 257-264. Cited in the spec.

European Search Report dated May 28, 2008, issued in corresponding European Patent Application Number 07251607.

The Nikkan Kogyo Shimbun, reporting the press release, Mar. 25, 2005 (English translation of Japanese document previously submitted with IDS filed Dec. 17, 2009).

The Dempa Shimbun, reporting the press release, Mar. 25,2005 (English translation of Japanese document previously submitted with IDS filed Dec. 17, 2009).

The Kagaku Kogyo Nippo, reporting the press release, Mar. 25,2005 (English translation of Japanese document previously submitted with IDS filed Dec. 17, 2009).

The Sekiyu Kagaku Shimbun Nikkan Tsushin, reporting the press release, Mar. 25, 2005 (English translation of Japanese document previously submitted with IDS filed Dec. 17, 2009).

The Nikkan Chemical News, reporting the press release, Mar. 25, 2005 (English translation of Japanese document previously submitted with IDS filed Dec. 17, 2009).

Nikkei Press Release, Mar. 25, 2005 (English translation of Japanese document previously submitted with IDS filed Dec. 17, 2009).

H. Nakamura; "Nd-Fe-B Sintered Magnets Produced by the Grain Boundary Diffusion Process", Bulletin of Topical Symposium of the Magnetic Society of Japan, Mar. 14,2006, pp. 13-18 (Shin-Etsu Chemical Co Ltd.) (English translation of Japanese document previously submitted with IDS filed Dec. 17, 2009).

K. Machida et al.;Grain Boundary Modification and Magnetic Properties of Nd-Fe-B Sintered Magnets (English translation of Japanese document previously submitted with IDS filed Dec. 17, 2009).

* cited by examiner (a) (b)

METHOD FOR PREPARING RARE EARTH PERMANENT MAGNET

CROSS-REFERENCE TO RELATED APPLICATION

This non-provisional application claims priority under 35 U.S.C. §119(a) on Patent Application No. 2006-311352 filed in Japan on Nov. 17, 2006, the entire contents of which are hereby incorporated by reference.

TECHNICAL FIELD

This invention relates to high-performance rare earth permanent magnets having a minimal amount of expensive rare earth elements such as Tb and Dy used.

BACKGROUND ART

By virtue of excellent magnetic properties, Nd—Fe—B permanent magnets find an ever increasing range of application. The recent challenge to the environmental problem has expanded the application range of these magnets from household electric appliances to industrial equipment, electric automobiles and wind power generators. It is required to further improve the performance of Nd—Fe—B permanent magnets.

Indexes for the performance of magnets include remanence (or residual magnetic flux density) and coercive force. An increase in the remanence of Nd—Fe—B permanent magnets can be achieved by increasing the volume factor of $Nd_2Fe_{14}B$ compound and improving the crystal orientation. To this end, a number of modifications have been made on the process. For increasing coercive force, there are known different approaches including grain refinement, the use of alloy compositions with greater Nd contents, and the addition of effective elements. The currently most common approach is to use alloy compositions having Dy or Tb substituted for part of Nd. Substituting these elements for Nd in the $Nd_2Fe_{14}B$ compound increases both the anisotropic magnetic field and the coercive force of the compound. The substitution with Dy or Tb, on the other hand, reduces the saturation magnetic polarization of the compound. Therefore, as long as the above approach is taken to increase coercive force, a loss of remanence is unavoidable. Since Tb and Dy are expensive metals, it is desired to minimize their addition amount.

In Nd—Fe—B permanent magnets, the coercive force is given by the magnitude of an external magnetic field which creates nuclei of reverse magnetic domains at grain boundaries. Formation of nuclei of reverse magnetic domains is largely dictated by the structure of the grain boundary in such a manner that any disorder of grain structure in proximity to the boundary invites a disturbance of magnetic structure, helping form reverse magnetic domains. It is generally believed that a magnetic structure extending from the grain boundary to a depth of about 5 nm contributes to an increase of coercive force (see K. D. Durst and H. Kronmuller, "THE COERCIVE FIELD OF SINTERED AND MELT-SPUN NdFeB MAGNETS," Journal of Magnetism and Magnetic Materials, 68 (1987), 63-75). For providing both a high coercive force and a high remanence, it is ideal that the concentration of Dy and Tb be higher in proximity to grain boundaries than within crystal grains.

An effective approach for achieving such a morphology is, as disclosed in WO 06/43348 by the present applicant, by disposing a powder containing one or more of oxides, fluorides, and oxyfluorides of rare earth elements on a surface of a sintered magnet body and heat treating the magnet body at a temperature below the sintering temperature in vacuum or an inert gas. This approach is referred to as "grain boundary diffusion process," hereinafter. With this process, Dy or Tb is incorporated into the sintered magnet body from the rare earth compound present on the sintered magnet body surface and diffused into the magnet body along grain boundaries. It is believed that diffusion of Dy or Tb only in proximity to grain boundaries facilitates to increase the coercive force. This causes a little or no loss of remanence because the substitution amount of Dy or Tb is very small relative to the overall crystal grains.

In general, the grain boundary phase of Nd—Fe—B permanent magnet includes a Nd-rich phase, a Nd oxide phase, and a B-rich phase. Among these, the Nd-rich phase becomes a liquid phase during the heat treatment, and Dy or Tb is dissolved in this liquid phase and diffused into the interior, which enables diffusion into a deep portion of the magnet having a depth of millimeter order, despite the relatively low temperature which is below the sintering temperature.

DISCLOSURE OF THE INVENTION

Since Nd—Fe—B alloys are highly active, they readily absorb incidental impurities such as oxygen, carbon and nitrogen during their preparation. These light elements react mainly with Nd to form compounds. The resulting oxide, carbide and nitride have melting points which are far higher than the sintering temperature and can exist as a solid phase during grain boundary diffusion treatment. Therefore, the impurities cause to reduce the amount of Nd-rich liquid phase. Then not only the amount of Nd in the mother alloy, but also the amount of impurities incorporated during the magnet preparing process must be taken into account before the amount of Nd-rich phase can be determined. In the grain boundary diffusion process, the Nd-rich phase becomes a diffusion medium for Dy and Tb as described above. Then, even if the amount of Nd-rich phase is sufficient for an ordinary permanent magnet to gain a coercive force, that amount can be insufficient to serve as the diffusion medium in the grain boundary diffusion process.

The total amount of Nd in the mother alloy is an approximate measure indicative of the amount of Nd-rich phase. It is appreciated that the more Nd in excess of the stoichiometry (11.76 atom % Nd) of $Nd_2Fe_{14}B$, the more is the amount of Nd-rich phase. While the Nd-rich phase is essential for magnets of the type discussed herein to acquire a high coercive force, it causes to reduce the fraction of $Nd_2Fe_{14}B$ phase contributing to magnetism. The principle commonly taken in development works to enhance magnet performance is to minimize the amount of Nd-rich phase as long as it still ensures a coercive force. However, it has not been practiced to optimize the amount of Nd-rich phase from the standpoint of diffusion medium in the grain boundary diffusion process, while considering the amount of incidental impurities such as oxygen, carbon and nitrogen incorporated during the magnet preparing process.

An object of the present invention is to provide an R—Fe—B permanent magnet comprising rare earth elements inclusive of Sc and Y, specifically Dy and/or Tb among other rare earth elements, wherein R is at least two elements selected from rare earth elements inclusive of Sc and Y, which magnet exhibits high performance and has a minimal amount of rare earth elements used, especially Dy and/or Tb.

As used herein, both R and $R^1$ refer to rare earth elements inclusive of Sc and Y. R is mainly used in conjunction with a magnet obtained by the grain boundary diffusion process or crystalline phases in an alloy while $R^1$ is mainly used in conjunction with starting materials and a sintered magnet body prior to the grain boundary diffusion treatment.

In an attempt to apply the grain boundary diffusion process to R—Fe—B permanent magnets, typically Nd—Fe—B permanent magnets, the inventors have found that the grain boundary diffusion process exerts a significant effect of increasing coercive force when the amount of Nd-rich phase serving as a diffusion medium in the manufacture of R—Fe—B permanent magnets by the grain boundary diffusion process is optimized on the basis of the amount of oxygen, carbon and nitrogen which are incidentally entrained or intentionally added to the magnets, and when the amount of rare earth elements is greater than the threshold determined by the amount of oxygen, carbon and nitrogen and the amount of boron. The present invention is predicated on this finding.

The present invention provides a method for preparing a rare earth permanent magnet, comprising the steps of:

disposing a powder on a surface of a sintered magnet body of $R^1{}_aT_bB_cM_dO_eC_fN_g$ composition wherein $R^1$ is at least one element selected from rare earth elements inclusive of Sc and Y, T is at least one element selected from Fe and Co, M is at least one element selected from the group consisting of Al, Cu, Zn, In, Si, P, S, Ti, V, Cr, Mn, Ni, Ga, Ge, Zr, Nb, Mo, Pd, Ag, Cd, Sn, Sb, Hf, Ta, and W, and "a" to "9" indicative of atomic percent based on the alloy are in the range: $12 \leqq a \leqq 17$, $3 \leqq c \leqq 15$, $0.01 \leqq d \leqq 11$, $0.1 \leqq e \leqq 4$, $0.05 \leqq f \leqq 3$, $0.01 \leqq g \leqq 1$, and the balance of b, and $a \geqq 12.5+(e+f+g)\times 0.67-c\times 0.11$, said powder comprising at least one compound selected from among an oxide of $R^2$, a fluoride of $R^3$, and an oxyfluoride of $R^4$ wherein each of $R^2$, $R^3$, and $R^4$ is at least one element selected from rare earth elements inclusive of Sc and Y, and heat treating the magnet body having the powder disposed on its surface at a temperature equal to or below the sintering temperature of the magnet body in vacuum or in an inert gas for 1 minute to 100 hours, for causing at least one of $R^2$, $R^3$ and $R^4$ in the powder to be absorbed in the magnet body.

In a preferred embodiment, the heat treatment of the magnet body is repeated at least two times. Also preferably, the method further comprises, after the heat treatment, effecting aging treatment at a lower temperature.

In preferred embodiments, $R^1$ contains at least 10 atom % of Nd and/or Pr; and T contains at least 50 atom % of Fe.

In other preferred embodiments, the powder has an average particle size of up to 100 μm; $R^2$, $R^3$ and $R^4$ each contain at least 10 atom % of Dy and/or Tb; the powder comprises a fluoride of $R^3$ and/or an oxyfluoride of $R^4$, and the heat treatment causes fluorine to be absorbed in the magnet body along with $R^3$ and/or $R^4$; in the powder comprising a fluoride of $R^3$ and/or an oxyfluoride of $R^4$, $R^3$ and/or $R^4$ contains at least 10 atom % of Dy and/or Tb and has a lower total concentration of Nd and Pr than the total concentration of Nd and Pr in $R^1$.

In a preferred embodiment, the powder comprising a fluoride of $R^3$ and/or an oxyfluoride of $R^4$ contains at least 10% by weight of a fluoride of $R^3$ and an oxyfluoride of $R^4$ combined and the balance of at least one compound selected from the group consisting of a carbide, nitride, boride, silicide, oxide, hydroxide, and hydride of $R^5$, and complex compounds comprising at least one of the foregoing wherein $R^5$ is at least one element selected from rare earth elements inclusive of Sc and Y.

In a preferred embodiment, the disposing step includes feeding a slurry of said powder dispersed in an aqueous or organic solvent to the magnet body surface.

In a preferred embodiment, the method further comprises washing the magnet body with at least one agent selected from alkalis, acids, and organic solvents before the powder is disposed on the magnet body; or shot blasting the magnet body for removing a surface layer before the powder is disposed on the magnet body. The method may further comprise, after the heat treatment, subjecting the magnet body to machining, plating or painting.

BENEFITS OF THE INVENTION

The R—Fe—B permanent magnet of the invention exhibits high performance and has a minimal amount of rare earth elements used, especially Dy and/or Tb.

DESCRIPTION OF THE PREFERRED EMBODIMENTS

Figure 1:
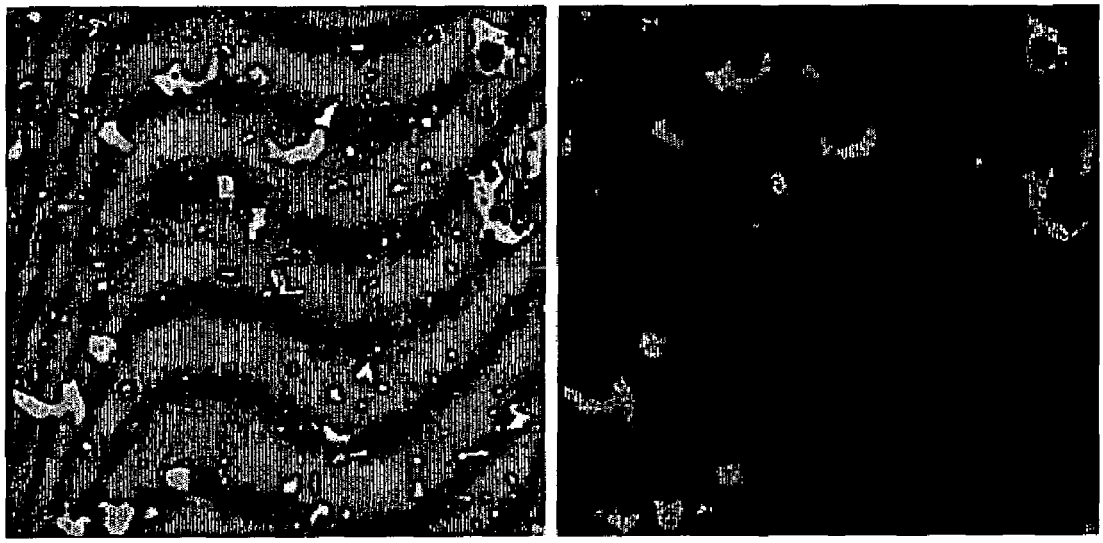
FIG. 1*a* is a back-scattering electron image under SEM of magnet M1-A prepared by the inventive method.
FIG. 1*b* is a fluorine profile of magnet M1-A as analyzed by EPMA.

According to the invention, a rare earth permanent magnet is generally prepared by providing a sintered magnet body of a selected composition, disposing a powder on a surface of the magnet body, and heat treating the powder-covered magnet body. The sintered magnet body is of $R^1{}_aT_bB_cM_dO_eC_fN_g$ composition wherein $R^1$ is at least one element selected from rare earth elements inclusive of scandium (Sc) and yttrium (Y), T is at least one element selected from iron (Fe) and cobalt (Co), B is boron, M is at least one element selected from the group consisting of Al, Cu, Zn, In, Si, P, S, Ti, V, Cr, Mn, Ni, Ga, Ge, Zr, Nb, Mo, Pd, Ag, Cd, Sn, Sb, Hf, Ta, and W, O is oxygen, C is carbon, N is nitrogen, and "a" to "g" indicative of atomic percent of corresponding elements based on the alloy are in the range: $12 \leqq a \leqq 17$, $3 \leqq c \leqq 15$, preferably $5 \leqq c \leqq 11$, more preferably $6 \leqq c \leqq 10$, $0.01 \leqq d \leqq 11$, $0.1 \leqq e \leqq 4$, $0.05 \leqq f \leqq 3$, $0.01 \leqq g \leqq 1$, and the balance of b, and $a \geqq 12.5+(e+f+g)\times 0.67-c\times 0.11$, preferably (e+f+g) being in the range; $0.16 \leqq (e+f+g) \leqq 6$, more preferably $0.5 \leqq (e+f+g) \leqq 5$, even more preferably $0.7 \leqq (e+f+g) \leqq 4$, still more preferably $0.8 \leqq (e+f+g) \leqq 3.3$, most preferably $1 \leqq (e+f+g) \leqq 3$. The powder comprises at least one compound selected from among an oxide of $R^2$, a fluoride of $R^3$, and an oxyfluoride of $R^1$ wherein each of $R^2$, $R^3$, and $R^4$ is at least one element selected from rare earth elements inclusive of Sc and Y. The magnet body having the powder disposed on its surface is heat treated at a temperature equal to or below the sintering temperature of the magnet body in vacuum or in an inert gas for a period of 1 minute to 100 hours, for causing at least one of $R^2$, $R^3$ and $R^4$ in the powder to be absorbed in the magnet body. This method is an application of the grain boundary diffusion process.

According to the invention, a, c, e, f, and g in the $R^1{}_aT_bB_cM_dO_eC_fN_g$ composition, that is, the amounts of rare earth element represented by $R^1$, boron, oxygen, carbon, and nitrogen should meet the relationship;

$$a \geqq 12.5+(e+f+g)\times 0.67-c\times 0.11.$$

Most often, a sintered magnet body to be heat treated together with a powder comprising at least one compound selected from among an oxide of $R^2$, a fluoride of $R^3$, and an oxyfluoride of $R^4$ in accordance with the grain boundary diffusion process may be obtained by a standard procedure including coarsely grinding a mother alloy, finely grinding, compacting and sintering. As a general rule, the composition of a sintered magnet body (specifically the contents of rare earth element represented by $R^1$, element represented by T, boron, and element represented by M) changes from the composition of mother alloy charged. This is because the atomic ratio of respective components is reduced by the incorporation of oxygen, carbon, nitrogen and other elements during the preparation process and because some of $R^1$ and M have high vapor pressures so that they evaporate during the preparation of a sintered magnet body, especially during the sintering step.

As described above, if the grain boundary diffusion process is applied to the powder-covered sintered magnet body without taking into account the amount of oxygen, carbon and nitrogen in the sintered magnet body to be heat treated together with the powder, the coercive force cannot be effectively increased. This is because the amount of a phase rich in rare earth elements, typically Nd serving mainly as a diffusion medium in the grain boundary diffusion process has been changed (often reduced) by the presence of oxygen, carbon and nitrogen.

According to the invention, in order to effectively increase the coercive force by the grain boundary diffusion process, the grain boundary diffusion process should be applied to the powder-covered sintered magnet body while the amount of a phase rich in rare earth elements, typically Nd is set above a certain level in accordance with the amount of oxygen, carbon and nitrogen in the sintered magnet body to be heat treated together with the powder. That is, the grain boundary diffusion process is applied to the powder-covered sintered magnet body wherein a, c, e, f, and g in the $R^1{}_aT_bB_cM_dO_eC_fN_g$ composition of the sintered magnet body to be heat treated together with the powder meets the relationship:

$$a \geqq 12.5+(e+f+g)\times 0.67-c\times 0.11.$$

A mother alloy from which the sintered magnet is derived preferably contains $R^1$, T, B and M. Herein $R^1$ is at least one element selected from rare earth elements inclusive of Sc and Y, specifically from among Sc, Y, La, Ce, Pr, Nd, Sm, Eu, Gd, Tb, Dy, Ho, Er, Yb, and Lu, with Nd, Pr and Dy being preferably predominant. It is preferred that rare earth elements represented by $R^1$ account for 12.5 to 20 atom %, more preferably 12.5 to 18 atom % of the overall mother alloy. Desirably $R^1$ contains at least 10 atom %, especially at least 50 atom % of Nd and/or Pr based on the entire $R^1$. T is one or both elements selected from iron (Fe) and cobalt (Co). The content of element represented by T, especially Fe is preferably at least 50 atom %, more preferably at least 60 atom %, especially at least 65 atom % of the overall mother alloy. It is preferred that boron (B) account for 2 to 16 atom %, more preferably 3 to 15 atom %, even more preferably 5 to 11 atom % of the overall mother alloy. M is at least one element selected from the group consisting of Al, Cu, Zn, In, Si, P, S, Ti, V, Cr, Mn, Ni, Ga, Ge, Zr, Nb, Mo, Pd, Ag, Cd, Sn, Sb, Hf, Ta, and W. The element represented by M is preferably contained in an amount of 0.01 to 11 atom %, especially 0.1 to 5 atom % of the overall mother alloy. It is permissible that the balance consist of incidental impurities such as carbon (C), nitrogen (N) and oxygen (O).

The mother alloy is prepared by melting metal or alloy feeds in vacuum or an inert gas atmosphere, preferably argon atmosphere, and casting the melt into a flat mold or book mold or strip casting. A possible alternative is a so-called two-alloy process involving separately preparing an alloy approximate to the $R_2Fe_{14}B$ compound composition constituting the primary phase of the relevant alloy and an R-rich alloy serving as a liquid phase aid at the sintering temperature, crushing, then weighing and mixing them. Notably, the alloy approximate to the primary phase composition is subjected to homogenizing treatment, if necessary, for the purpose of increasing the amount of the $R_2Fe_{14}B$ compound phase, since α-Fe is likely to be left depending on the cooling rate during casting and the alloy composition. The homogenizing treatment is a heat treatment at 700 to 1,200° C. for at least one hour in vacuum or in an Ar atmosphere. To the R-rich alloy serving as a liquid phase aid, the melt quenching and strip casting techniques are applicable as well as the above-described casting technique.

Notably, intentional incorporation of oxygen, carbon and nitrogen into the magnet is possible by admixing the alloy powder with at least one of a carbide, nitride, oxide and hydroxide of $R^1$ (which is as defined above) or a mixture or composite thereof in an amount of 0.005 to 5% by weight in the grinding step which will be described below.

The mother alloy is generally crushed or coarsely ground to a size of 0.05 to 3 mm, especially 0.05 to 1.5 mm. The crushing step uses a Brown mill or hydriding pulverization, with the hydriding pulverization being preferred for those mother alloys as strip cast. The coarse powder is then finely divided to an average particle size of 0.2 to 30 μm, especially 0.5 to 20 μm, for example, on a jet mill using high-pressure nitrogen. The average particle size is determined as a weight average diameter $D_{50}$ (particle diameter at 50% by weight cumulative, or median diameter) using, for example, a particle size distribution measuring instrument relying on laser diffractometry or the like. It is noted that the oxygen content of a sintered body can also be adjusted by admixing a minor amount of oxygen into the high-pressure nitrogen.

The fine powder is compacted on a compression molding machine under a magnetic field. The oxygen content of a sintered body can also be adjusted by the particle size reached by fine grinding, the atmosphere during compaction, and the exposure time. The green compact is then placed in a sintering furnace where it is sintered in vacuum or in an inert gas atmosphere usually at a temperature of 900 to 1,250° C., preferably 1,000 to 1,100° C. The sintered magnet block thus obtained contains 60 to 99% by volume, preferably 80 to 98% by volume of the tetragonal $R_2Fe_{14}B$ compound as the primary phase, with the balance being 0.5 to 20% by volume of an R-rich phase (wherein R is a rare earth element inclusive of Sc and Y), 0 to 10% by volume of a B-rich phase, and 0.1 to 10% by volume of at least one compound selected from among an oxide, carbide, nitride and hydroxide of R (which is a rare earth element inclusive of Sc and Y) or a mixture or composite thereof.

The resulting sintered magnet block is generally machined or worked into a predetermined shape. The dimensions of the shape are not particularly limited. In the invention, the amount of $R^2$, $R^3$ or $R^4$ absorbed into the magnet body from the powder deposited on the magnet surface and comprising at least one of $R^2$ oxide, $R^3$ fluoride and $R^4$ oxyfluoride increases as the specific surface area of the magnet body is larger, i.e., the size thereof is smaller. For this reason, the shape includes a maximum side having a dimension of up to 100 mm, preferably up to 50 mm, and more preferably up to 20 mm, and has a dimension of up to 10 mm, preferably up to 5 mm, and more preferably up to 2 mm in the direction of magnetic anisotropy. Most preferably, the dimension in the magnetic anisotropy direction is up to 1 mm.

With respect to the dimension of the maximum side and the dimension in the magnetic anisotropy direction, no particular lower limit is imposed. Preferably, the dimension of the maximum side is at least 0.1 mm and the dimension in the magnetic anisotropy direction is at least 0.05 mm.

After machining, a powder comprising at least one compound selected from among an oxide of $R^2$, a fluoride of $R^3$, and an oxyfluoride of $R^4$, preferably a fluoride of $R^3$ and/or an oxyfluoride of $R^4$ is disposed on the surface of a (machined) sintered magnet body. As defined above, each of $R^2$, $R^3$ and $R^4$ is at least one element selected from rare earth elements inclusive of Y and Sc, and should preferably contain at least 10 atom %, more preferably at least 20 atom %, and even more preferably at least 40 atom % of Dy and/or Tb.

For the reason that a more amount of $R^2$, $R^3$ or $R^4$ is absorbed as the filling factor of the powder in the magnet surface-surrounding space is higher, the filling factor should preferably be at least 10% by volume, more preferably at least 40% by volume, calculated as an average value in a magnet-surrounding space extending outward from the magnet surface to a distance equal to or less than 1 mm, in order that the grain boundary diffusion process exert a better effect. One exemplary technique of disposing or applying the powder is by dispersing a powder comprising one or more compounds selected from an oxide of $R^2$, a fluoride of $R^3$, and an oxyfluoride of $R^4$ in water or an organic solvent to form a slurry, immersing the magnet body in the slurry, and drying in hot air or in vacuum or drying in the ambient air. Alternatively, the powder can be applied by spray coating or the like. Any such technique is characterized by ease of application and mass treatment.

The particle size of the fine powder affects the reactivity when the $R^2$, $R^3$ or $R^4$ component in the powder is absorbed in the magnet body. Smaller particles offer a larger contact area available for the reaction. In order for the invention to attain its effects, the powder disposed on the magnet should desirably have an average particle size equal to or less than 100 μm, preferably equal to or less than 10 μm. No particular lower limit is imposed on the particle size although a particle size of at least 1 nm is preferred. It is noted that the average particle size is determined as a weight average diameter $D_{50}$ (particle diameter at 50% by weight cumulative, or median diameter) using, for example, a particle size distribution measuring instrument relying on laser diffractometry or the like.

The oxide of $R^2$, fluoride of $R^3$, and oxyfluoride of $R^4$ used herein are typically $R^2{}_2O_3$, $R^3F_3$, and $R^4OF$, respectively, although they generally refer to oxides containing $R^2$ and oxygen, fluorides containing $R^3$ and fluorine, and oxyfluorides containing $R^4$, oxygen and fluorine, additionally including $R^2O_n$, $R^3F_n$, and $R^4O_nF_n$ wherein m and n are arbitrary positive numbers, and modified forms in which part of $R^2$ to $R^4$ is substituted or stabilized with another metal element as long as they can achieve the benefits of the invention.

The powder disposed on the magnet surface contains the oxide of $R^2$, fluoride of $R^3$, oxyfluoride of $R^4$ or a mixture thereof, and may additionally contain at least one compound selected from among carbides, nitrides, borides, silicides, oxides, hydroxides and hydrides of $R^5$, or a mixture or composite thereof wherein $R^5$ is at least one element selected from rare earth elements inclusive of Y and Sc. When $R^3$ fluoride and/or $R^4$ oxyfluoride is used, the powder may contain an oxide of $R^5$. Further, the powder may contain a fine powder of boron, boron nitride, silicon, carbon or the like, or an organic compound such as stearic acid in order to promote the dispersion or chemical/physical adsorption of the powder. In order for the invention to attain its effect efficiently, the powder should preferably contain at least 10% by weight, more preferably at least 20% by weight (based on the entire powder) of the oxide of $R^2$, fluoride of $R^3$, oxyfluoride of $R^4$ or a mixture thereof. In particular, it is recommended that the powder contain at least 90% by weight of the oxide of $R^2$, fluoride of $R^3$, oxyfluoride of $R^4$ or a mixture thereof.

After the powder comprising the oxide of $R^2$, fluoride of $R^3$, oxyfluoride of $R^4$ or a mixture thereof is disposed on the magnet body surface as described above, the magnet body and the powder are heat treated in vacuum or in an atmosphere of an inert gas such as argon (Ar) or helium (He). This heat treatment is referred to as "absorption treatment." The absorption treatment temperature is equal to or below the sintering temperature (designated Ts in ° C.) of the magnet body.

If heat treatment is effected above the sintering temperature Ts, there arise problems that (1) the structure of the sintered magnet can be altered to degrade magnetic properties, (2) the machined dimensions cannot be maintained due to thermal deformation, and (3) $R^2$, $R^3$ and $R^4$ can diffuse not only at grain boundaries, but also into the interior of the magnet body, detracting from remanence. For this reason, the temperature of heat treatment is equal to or below Ts° C. of the magnet body, and preferably equal to or below (Ts−10)° C. The lower limit of temperature may be selected as appropriate though it is typically at least 350° C. The time of absorption treatment is typically from 1 minute to 100 hours. Within less than 1 minute, the absorption treatment is not complete. If over 100 hours, the structure of the sintered magnet can be altered and oxidation or evaporation of components inevitably occurs to degrade magnetic properties. The preferred time of heat treatment is from 5 minutes to 8 hours, and more preferably from 10 minutes to 6 hours.

Through the absorption treatment, $R^2$, $R^3$ or $R^4$ contained in the powder disposed on the magnet surface is concentrated in the rare earth-rich grain boundary component within the magnet so that $R^2$, $R^3$ or $R^4$ is incorporated in a substituted manner near a surface layer of $R_2Fe_{14}B$ primary phase grains. Where the powder contains the fluoride of $R^3$ or oxyfluoride of $R^4$, part of the fluorine in the powder is absorbed in the magnet along with $R^3$ or $R^4$ to promote a supply of $R^3$ or $R^4$ from the powder and the diffusion thereof along grain boundaries in the magnet.

The rare earth element contained in the oxide of $R^2$, fluoride of $R^3$ or oxyfluoride of $R^4$ is one or more elements selected from rare earth elements inclusive of Y and Sc. Since the elements which are particularly effective for enhancing magnetocrystalline anisotropy when concentrated in a surface layer are Dy and Tb, it is preferred that a total of Dy and Tb account for at least 10 atom % and more preferably at least 20 atom % of the rare earth elements in the powder. Also preferably, the total concentration of Nd and Pr in $R^2$, $R^3$ and $R^4$ is lower than the total concentration of Nd and Pr in $R^1$. It is most preferred to the objects of the invention to use a powder comprising a fluoride of $R^3$ and/or an oxyfluoride of $R^4$ and especially such a powder in which $R^3$ and/or $R^4$ contains at least 10 atom % of Dy and/or Tb, and the total concentration of Nd and Pr in $R^3$ and/or $R^4$ is lower than the total concentration of Nd and Pr in $R^1$.

The absorption treatment effectively increases the coercive force of the R—Fe—B permanent magnet without substantial sacrifice of remanence.

The absorption treatment may be carried out, for example, by dispersing the powder in water or an organic solvent to form a slurry, immersing the sintered magnet body in the slurry, and heat treating the magnet body having the powder deposited on its surface. Since a plurality of magnet bodies each covered with the powder are spaced apart from each other during the absorption treatment, it is avoided that the magnet bodies are fused together after the absorption treatment which is a heat treatment at a high temperature. In addition, the powder is not fused to the magnet bodies after the absorption treatment. It is then possible to place a multiplicity of magnet bodies in a heat treating container where they are treated simultaneously. The preparing method of the invention is highly productive.

It is noted that the step of heat treating the sintered magnet body while maintaining the powder on its surface may be repeated two or more times or carried out in two or more divided stages.

The absorption treatment is preferably followed by aging treatment. The aging treatment is desirably at a temperature which is below the absorption treatment temperature, preferably from 200° C. to a temperature lower than the absorption treatment temperature by 10° C., more preferably from 350° C. to a temperature lower than the absorption treatment temperature by 10° C. The atmosphere is preferably vacuum or an inert gas such as Ar or He. The time of aging treatment is preferably from 1 minute to 10 hours, more preferably from 10 minutes to 5 hours, and even more preferably from 30 minutes to 2 hours.

Notably, during machining of the sintered magnet block prior to the coverage thereof with the powder, the machining tool may use an aqueous cooling fluid or the machined surface may be exposed to a high temperature. If so, there is a likelihood that the machined surface (or a surface layer of the sintered magnet body) is oxidized to form an oxide layer thereon. This oxide layer sometimes inhibits the absorption reaction of $R^2$, $R^3$ or $R^4$ from the powder into the magnet body. In such a case, the magnet body as machined is washed with at least one of alkalis, acids and organic solvents or shot blasted for removing the oxide layer. Then the magnet body is ready for absorption treatment.

Suitable alkalis which can be used herein include potassium pyrophosphate, sodium pyrophosphate, potassium citrate, sodium citrate, potassium acetate, sodium acetate, potassium oxalate, sodium oxalate, etc. Suitable acids include hydrochloric acid, nitric acid, sulfuric acid, acetic acid, citric acid, tartaric acid, etc. Suitable organic solvents include acetone, methanol, ethanol, isopropyl alcohol, etc. In the washing step, the alkali or acid may be used as an aqueous solution with a suitable concentration not attacking the magnet body.

Also, after the absorption treatment or after the subsequent aging treatment, the magnet body may be washed with at least one agent selected from alkalis, acids and organic solvents, or machined again into a practical shape.

Alternatively, plating or paint coating may be carried out after the absorption treatment, after the aging treatment, after the washing step, or after the last machining step.

By the method of the invention, a permanent magnet can be produced having a coercive force which is higher than that of the sintered magnet body prior to heat treatment by at least 280 kA/m, and especially at least 300 kA/m. The permanent magnet produced by the method is a high-performance permanent magnet having a substantially increased coercive force.

EXAMPLE

Examples are given below for further illustrating the invention although the invention is not limited thereto. In Examples, the filling factor (or percent occupancy) of the magnet surface-surrounding space with a powdered compound like dysprosium fluoride is calculated from a weight gain of the magnet after powder deposition and the true density of powder material.

The analytical methods of the elements were as follows.

O: Inert gas fusion infrared absorption spectrometry

C: Burning infrared absorption spectrometry

N: Inert gas fusion thermal conductivity detection method

F: Distillation-absorption spectroscopy Nd, Pr, Dy, Tb, Fe, Co, B, Al, Cu, Zn, In, Si, P, S, Ti, V, Cr, Mn, Ni, Ga, Ge, Zr, Nb, Mo, Pd, Ag, Cd, Sn, Sb, Hf, Ta, and W: ICP (Inductively Coupled Plasma Atomic Emission Spectrometry) method.

Example 1

A mother alloy in thin plate form was prepared by a strip casting technique, specifically by weighing Nd, Al, Fe and Cu metals having a purity of at least 99% by weight and ferroboron, high-frequency heating in an argon atmosphere for melting, and casting the alloy melt on a copper single roll. The mother alloy consisted of 13.5 atom % of Nd, 0.5 atom % of Al, 0.3 atom % of Cu, 5.8 atom % of B, and the balance of Fe. Hydriding pulverization was carried out by exposing the alloy to 0.11 MPa of hydrogen at room temperature to occlude hydrogen and then heating at 500° C. for partial dehydriding while evacuating to vacuum. The pulverized alloy was cooled and sieved, yielding a coarse powder under 50 mesh.

Subsequently, the coarse powder was finely pulverized on a jet mill using high-pressure nitrogen gas into a fine powder having a mass median particle diameter of 5.1 μm. The fine powder was compacted in a nitrogen atmosphere under a pressure of about 100 MPa while being oriented in a magnetic field of 1.2 MA/m. The green compact was then placed in a sintering furnace with an argon atmosphere where it was sintered at 1,060° C. for 2 hours, obtaining a sintered magnet block M1. The block M1 had a composition shown in Table 1. Table 1 also reports the required minimum content of $R^1$ (Nd in this example) that is determined as a function of the contents of oxygen, carbon, nitrogen and boron, that is, given by the following equation.

$$R^1_{min}(\text{at }\%)=12.5+[O(\text{at }\%)+C(\text{at }\%)+N(\text{at }\%)]\times 0.67-B(\text{at }\%)\times 0.11$$

It is seen that the Nd content is greater than the required minimum content ($R^1_{min}$).

Using a diamond grinding tool, magnet block M1 was machined on all the surfaces into a magnet body having dimensions of 15×15×3 mm. It was washed in sequence with alkaline solution, deionized water, nitric acid and deionized water, and dried.

Subsequently, dysprosium fluoride having an average particle size of 1.5 μm was mixed with deionized water at a weight fraction of 50% to form a suspension, in which the magnet body was immersed for 30 seconds with ultrasonic waves being applied. The magnet body was pulled up and placed in a vacuum desiccator where it was dried for 30 minutes at room temperature in an atmosphere evacuated by a rotary pump. At this point, the dysprosium fluoride surrounded the magnet body and occupied a magnet surface-surrounding space at a filling factor of 45% by volume.

The magnet body covered with dysprosium fluoride was subjected to absorption treatment in an argon atmosphere at 820° C. for 8 hours. It was then subjected to aging treatment at 500° C. for one hour, and quenched, obtaining a magnet within the scope of the invention. It is designated magnet M1-A. For evaluating an increase of coercive force by grain boundary diffusion treatment, a magnet was prepared by subjecting a similar magnet body to heat treatment in the absence of dysprosium fluoride and aging treatment (i.e., without absorption treatment). It is designated magnet M1-B. For magnets M1-A and M1-B, the coercive force and the increment of coercive force by grain boundary diffusion are shown in Table 1. It is seen that the grain boundary diffusion treatment increased the coercive force by 437 kA/m.

FIG. 1*a* is a back-scattering electron image of a cross section of magnet M1-A, and FIG. 1*b* is a fluorine profile of magnet M1-A. Fluorine exists at the triple point surrounded by $R_2Fe_{14}B$ grains, indicating that when a fluoride is used during the grain boundary diffusion treatment, fluorine is also absorbed.

Magnet M1-A was machined on all the surfaces into dimensions of 4×4×2.4 mm. It is designated magnet M1-A-1. The magnet was further subjected to electroless Cu/Ni plating, which is designated M1-A-2, or to epoxy coating, which is designated M1-A-3. The coercive force of magnets M1-A-1 to M1-A-3 is shown in Table 1, indicating that the magnets maintain a high coercive force even when machined, plated and painted after the grain boundary diffusion treatment.

Comparative Example 1

A mother alloy in thin plate form was prepared by a strip casting technique, specifically by weighing Nd, Al, Fe and Cu metals having a purity of at least 99% by weight and ferroboron, high-frequency heating in an argon atmosphere for melting, and casting the alloy melt on a copper single roll. The mother alloy consisted of 12.5 atom % of Nd, 0.5 atom % of Al, 0.3 atom % of Cu, 5.8 atom % of B, and the balance of Fe. This mother alloy composition has a Nd content which is I atom % lower than that of Example 1 (a Fe content of 1 atom % greater). This mother alloy was pulverized, compacted, and sintered as in Example 1, obtaining a sintered magnet block P1. The composition and the required minimum content ($R^1_{min}$) of magnet block P1 are shown in Table 1. It is seen that the Nd content is less than $R^1_{min}$.

As in Example 1, magnet block P1 was machined and subjected to grain boundary diffusion treatment and aging treatment. It is designated magnet P1-A. For evaluating an increase of coercive force by grain boundary diffusion treatment, a magnet was prepared by subjecting a similar magnet body to heat treatment in the absence of dysprosium fluoride and aging treatment (i.e., without absorption treatment). It is designated magnet P1-B. For magnets P1-A and P1-B, the coercive force and the increment of coercive force by grain boundary diffusion are shown in Table 1. It is seen that the grain boundary diffusion treatment increased the coercive force by only 119 kA/m.

TABLE 1

| | | Example 1 M1 | Comparative Example 1 P1 |
|---|---|---|---|
| Composition of original magnet (atom %) | $R^1$ | 12.83 | 12.13 |
| | T | 79.85 | 80.62 |
| | B | 5.80 | 5.78 |
| | M | 0.80 | 0.80 |
| | O | 0.32 | 0.30 |
| | C | 0.31 | 0.28 |
| | N | 0.09 | 0.11 |
| | $R^1_{min}$ | 12.34 | 12.33 |
| Coercive force (kA/m) | A (absorption treatment) | 1432 | 1074 |
| | B (no absorption treatment) | 995 | 955 |
| | Increment by boundary diffusion | 437 | 119 |
| | M1-A-1 | 1424 | |
| | M1-A-2 | 1440 | |
| | M1-A-3 | 1416 | |

Example 2

A mother alloy in thin plate form was prepared by a strip casting technique, specifically by weighing Nd, Pr, Al, Fe and Cu metals having a purity of at least 99% by weight and ferroboron, high-frequency heating in an argon atmosphere for melting, and casting the alloy melt on a copper single roll. The mother alloy consisted of 11.0 atom % of Nd, 1.5 atom % of Pr, 0.5 atom % of Al, 0.3 atom % of Cu, 5.8 atom % of B, and the balance of Fe. Hydriding pulverization was carried out by exposing the alloy to 0.11 MPa of hydrogen at room temperature to occlude hydrogen and then heating at 500° C. for partial dehydriding while evacuating to vacuum. The pulverized alloy was cooled and sieved, yielding a coarse powder under 50 mesh.

Subsequently, the coarse powder was finely pulverized on a jet mill using high-pressure nitrogen gas into a fine powder having a mass median particle diameter of 5.5 μm. The fine powder was compacted in a nitrogen atmosphere under a pressure of about 100 MPa while being oriented in a magnetic field of 1.2 MA/m. The green compact was then placed in a sintering furnace with an argon atmosphere where it was sintered at 1,060° C. for 2 hours, obtaining a sintered magnet block M2. The composition and the required minimum content ($R^1_{min}$) of block M2 are shown in Table 2. It is seen that the Nd+Pr content is greater than $R^1_{min}$.

Using a diamond grinding tool, magnet block M2 was machined on all the surfaces into a magnet body having dimensions of 10×10×3 mm. It was washed in sequence with alkaline solution, deionized water, nitric acid and deionized water, and dried.

Subsequently, terbium fluoride having an average particle size of 1.0 μm was mixed with deionized water at a weight fraction of 50% to form a suspension, in which the magnet body was immersed for 30 seconds with ultrasonic waves being applied. The magnet body was pulled up and immediately dried with a hot air blow. At this point, the terbium fluoride surrounded the magnet body and occupied a magnet surface-surrounding space at a filling factor of 55% by volume.

The magnet body covered with terbium fluoride was subjected to absorption treatment in an argon atmosphere at 800° C. for 14 hours. It was then subjected to aging treatment at 500° C. for one hour, and quenched, obtaining a magnet designated M2-A. For evaluating an increase of coercive force by grain boundary diffusion treatment, a magnet was prepared by subjecting a similar magnet body to heat treatment in the absence of terbium fluoride and aging treatment (i.e., without absorption treatment). It is designated magnet M2-B. For magnets M2-A and M2-B, the coercive force and the increment of coercive force by grain boundary diffusion are shown in Table 2. It is seen that the grain boundary diffusion treatment increased the coercive force by 429 kA/m.

Comparative Example 2

A mother alloy in thin plate form was prepared with the same composition and under the same conditions as in Example 2. Under the same conditions as in Example 2, the mother alloy was pulverized into a coarse powder under 50 mesh. Subsequently, the coarse powder was finely pulverized on a jet mill using high-pressure nitrogen gas into a fine powder having a mass median particle diameter of 3.8 μm. The fine powder was compacted and sintered as in Example 2, obtaining a sintered magnet block P2. The composition and the required minimum content ($R^1_{min}$) of block P2 are shown in Table 2. The parameter different from Example 2 is the particle size of fine powder, and as a result, sintered magnet block P2 has a higher oxygen concentration. It is seen that the Nd+Pr content is less than $R^1_{min}$.

As in Example 2, magnet block P2 was machined and subjected to grain boundary diffusion treatment and aging treatment. It is designated magnet P2A. For evaluating an increase of coercive force by grain boundary diffusion treatment, a magnet was prepared by subjecting a similar magnet body to heat treatment in the absence of terbium fluoride and aging treatment (i.e., without absorption treatment). It is designated magnet P2B. For magnets P2A and P2B, the coercive force and the increment of coercive force by grain boundary diffusion are shown in Table 2. It is seen that the grain boundary diffusion treatment increased the coercive force by only 199 kA/m.

TABLE 2

| | | Example 2 M2 | Comparative Example 2 P2 |
|---|---|---|---|
| Composition of original magnet (atom %) | $R^1$ | 12.69 | 12.56 |
| | T | 79.82 | 79.69 |
| | B | 5.79 | 5.78 |
| | M | 0.80 | 0.80 |
| | O | 0.46 | 0.77 |
| | C | 0.35 | 0.36 |
| | N | 0.09 | 0.02 |
| | $R^1_{min}$ | 12.47 | 12.63 |
| Coercive force (kA/m) | A (absorption treatment) | 1464 | 1329 |
| | B (no absorption treatment) | 1035 | 1130 |
| | Increment by boundary diffusion | 429 | 199 |

Example 3

A mother alloy in thin plate form was prepared by a strip casting technique, specifically by weighing Nd, Dy, Co, Al, Fe and Cu metals having a purity of at least 99% by weight and ferroboron, high-frequency heating in an argon atmosphere for melting, and casting the alloy melt on a copper single roll. The mother alloy consisted of 13.0 atom % of Nd, 1.0 atom % of Dy, 2.0 atom % of Co, 0.5 atom % of Al, 0.3 atom % of Cu, 6.0 atom % of B, and the balance of Fe. Hydriding pulverization was carried out by exposing the alloy to 0.11 MPa of hydrogen at room temperature to occlude hydrogen and then heating at 500° C. for partial dehydriding while evacuating to vacuum. The pulverized alloy was cooled and sieved, yielding a coarse powder under 50 mesh.

Subsequently, the coarse powder was finely pulverized on a jet mill using high-pressure nitrogen gas into a fine powder having a mass median particle diameter of 6.0 μm. The fine powder was compacted in a nitrogen atmosphere under a pressure of about 100 MPa while being oriented in a magnetic field of 1.2 MA/m. The green compact was then placed in a sintering furnace with an argon atmosphere where it was sintered at 1,060° C. for 2 hours, obtaining a sintered magnet block M3. The composition and the required minimum content ($R^1_{min}$) of block M3 are shown in Table 3. It is seen that the Nd+Dy content is greater than $R^1_{min}$.

Using a diamond grinding tool, magnet block M3 was machined on all the surfaces into a magnet body having dimensions of 7×7×7 mm. It was washed in sequence with alkaline solution, deionized water, nitric acid and deionized water, and dried.

Subsequently, terbium oxide having an average particle size of 0.5 μm was mixed with deionized water at a weight fraction of 50% to form a suspension, in which the magnet body was immersed for 30 seconds with ultrasonic waves being applied. The magnet body was pulled up and immediately dried with a hot air blow. At this point, the terbium oxide surrounded the magnet body and occupied a magnet surface-surrounding space at a filling factor of 65% by volume.

The magnet body covered with terbium oxide was subjected to absorption treatment in an argon atmosphere at 850° C. for 10 hours. It was then subjected to aging treatment at 510° C. for one hour, and quenched, obtaining a magnet designated M3-A. For evaluating an increase of coercive force by grain boundary diffusion treatment, a magnet was prepared by subjecting a similar magnet body to heat treatment in the absence of terbium oxide and aging treatment (i.e., without absorption treatment). It is designated magnet M3-B. For magnets M3-A and M3-B, the coercive force and the increment of coercive force by grain boundary diffusion are shown in Table 3. It is seen that the grain boundary diffusion treatment increased the coercive force by 477 kA/m.

Comparative Example 3

A mother alloy in thin plate form was prepared with the same composition and under the same conditions as in Example 3. Under the same conditions as in Example 3, the mother alloy was pulverized into a fine powder having a mass median particle diameter of 3.8 μm. The fine powder was compacted in air under a pressure of about 100 MPa while being oriented in a magnetic field of 1.2 MA/m. The green compact was then sintered as in Example 3, obtaining a sintered magnet block P3. The composition and the required minimum content ($R^1_{min}$) of block P3 are shown in Table 3. The parameter different from Example 3 is the atmosphere of the compacting step, and as a result, sintered magnet block P3 has a higher oxygen concentration. It is seen that the Nd+Dy content is less than $R^1_{min}$.

As in Example 3, magnet block P3 was machined and subjected to grain boundary diffusion treatment and aging treatment. It is designated magnet P3-A. For evaluating an increase of coercive force by grain boundary diffusion treatment, a magnet was prepared by subjecting a similar magnet body to heat treatment in the absence of terbium oxide and aging treatment (i.e., without absorption treatment). It is designated magnet P3-B. For magnets P3-A and P3-B, the coercive force and the increment of coercive force by grain boundary diffusion are shown in Table 3. It is seen that the grain boundary diffusion treatment increased the coercive force by only 159 kA/m.

TABLE 3

| | | Example 3 M3 | Comparative Example 3 P3 |
|---|---|---|---|
| Composition of original magnet (atom %) | $R^1$ | 13.16 | 13.16 |
| | T | 79.13 | 78.03 |
| | B | 5.99 | 5.91 |
| | M | 0.80 | 0.79 |
| | O | 0.45 | 1.71 |
| | C | 0.39 | 0.35 |
| | N | 0.10 | 0.03 |
| | $R^1_{min}$ | 12.47 | 13.25 |
| Coercive force (kA/m) | A (absorption treatment) | 1631 | 1305 |
| | B (no absorption treatment) | 1154 | 1146 |
| | Increment by boundary diffusion | 477 | 159 |

Example 4

A mother alloy in thin plate form was prepared by a strip casting technique, specifically by weighing Nd, Co, Al, Fe and Cu metals having a purity of at least 99% by weight and ferroboron, high-frequency heating in an argon atmosphere for melting, and casting the alloy melt on a copper single roll. The mother alloy consisted of 13.5 atom % of Nd, 1.0 atom % of Co, 0.2 atom % of Al, 0.2 atom % of Cu, 5.9 atom % of B, and the balance of Fe. Hydriding pulverization was carried out by exposing the alloy to 0.11 MPa of hydrogen at room temperature to occlude hydrogen and then heating at 500° C. for partial dehydriding while evacuating to vacuum. The pulverized alloy was cooled and sieved, yielding a coarse powder under 50 mesh.

Subsequently, the coarse powder was finely pulverized on a jet mill using high-pressure nitrogen gas into a fine powder having a mass median particle diameter of 4.7 μm. The fine powder was compacted in a nitrogen atmosphere under a pressure of about 100 MPa while being oriented in a magnetic field of 1.2 MA/m. The green compact was then placed in a sintering furnace with an argon atmosphere where it was sintered at 1,060° C. for 2 hours, obtaining a sintered magnet block M4. The composition and the required minimum content ($R^1_{min}$) of block M4 are shown in Table 4. It is seen that the Nd content is greater than $R^1_{min}$.

Using a diamond grinding tool, magnet block M4 was machined on all the surfaces into a magnet body having dimensions of 20×10×3 mm. It was shot blasted to remove a surface coating, washed with deionized water, and dried.

Subsequently, dysprosium oxide and dysprosium fluoride having an average particle size of 1.0 μm and 2.5 μm, respectively, were mixed in a weight ratio of 70:30 to form a powder mixture. It was mixed with deionized water at a weight fraction of 50% to form a suspension, in which the magnet body was immersed for 30 seconds with ultrasonic waves being applied. The magnet body was pulled up and immediately dried with a hot air blow. At this point, the powder mixture surrounded the magnet body and occupied a magnet surface-surrounding space at a filling factor of 55% by volume.

The magnet body covered with the powder mixture was subjected to absorption treatment in an argon atmosphere at 875° C. for 5 hours. It was then subjected to aging treatment at 500° C. for one hour, and quenched, obtaining a magnet designated M4-A. For evaluating an increase of coercive force by grain boundary diffusion treatment, a magnet was prepared by subjecting a similar magnet body to heat treatment in the absence of the powder mixture and aging treatment (i.e., without absorption treatment). It is designated magnet M4-B. For magnets M4-A and M4-B, the coercive force and the increment of coercive force by grain boundary diffusion are shown in Table 4. It is seen that the grain boundary diffusion treatment increased the coercive force by 318 kA/m.

Comparative Example 4

A mother alloy in thin plate form was prepared with the same composition and under the same conditions as in Example 4. Under the same conditions as in Example 4, the mother alloy was pulverized into a coarse powder under 50 mesh. This coarse powder was admixed with 0.1% by weight of retort carbon having a mass median particle diameter of 25 μm. The carbon-laden coarse powder was finely pulverized, compacted under a magnetic field, and sintered under the same conditions as in Example 4, yielding a sintered magnet block P4. The composition and the required minimum content ($R^1_{min}$) of block P4 are shown in Table 4. It is seen that the Nd content is less than $R^1_{min}$.

As in Example 4, magnet block P4 was machined and subjected to grain boundary diffusion treatment and aging treatment. It is designated magnet P4-A. For evaluating an increase of coercive force by grain boundary diffusion treatment, a magnet was prepared by subjecting a similar magnet body to heat treatment in the absence of the powder mixture and aging treatment (i.e., without absorption treatment). It is designated magnet P4-B. For magnets P4-A and P4-B, the coercive force and the increment of coercive force by grain boundary diffusion are shown in Table 4. It is seen that the grain boundary diffusion treatment increased the coercive force by only 95 kA/m.

TABLE 4

| | | Example 4 M4 | Comparative Example 4 P4 |
|---|---|---|---|
| Composition of original magnet (atom %) | $R^1$ | 12.69 | 12.69 |
| | T | 80.29 | 79.77 |
| | B | 5.91 | 5.87 |
| | M | 0.40 | 0.40 |
| | O | 0.30 | 0.32 |
| | C | 0.29 | 0.84 |
| | N | 0.15 | 0.14 |
| | $R^1_{min}$ | 12.35 | 12.73 |
| Coercive force (kA/m) | A (absorption treatment) | 1313 | 1058 |
| | B (no absorption treatment) | 995 | 963 |
| | Increment by boundary diffusion | 318 | 95 |

Example 5

A mother alloy in thin plate form was prepared by a strip casting technique, specifically by weighing Nd, Pr, Tb, Al, Fe and Cu metals having a purity of at least 99% by weight and ferroboron, high-frequency heating in an argon atmosphere for melting, and casting the alloy melt on a copper single roll. The mother alloy consisted of 12.0 atom % of Nd, 1.5 atom % of Pr, 0.5 atom % of Tb, 0.2 atom % of Al, 0.2 atom % of Cu, 6.0 atom % of B, and the balance of Fe. Hydriding pulverization was carried out by exposing the alloy to 0.11 MPa of hydrogen at room temperature to occlude hydrogen and then heating at 500° C. for partial dehydriding while evacuating to vacuum. The pulverized alloy was cooled and sieved, yielding a coarse powder under 50 mesh.

Subsequently, the coarse powder was finely pulverized on a jet mill using high-pressure nitrogen gas into a fine powder having a mass median particle diameter of 5.5 μm. The fine powder was compacted in a nitrogen atmosphere under a pressure of about 100 MPa while being oriented in a magnetic field of 1.2 MA/m. The green compact was then placed in a sintering furnace with an argon atmosphere where it was sintered at 1,060° C. for 2 hours, obtaining a sintered magnet block M5. The composition and the required minimum content ($R^1_{min}$) of block M5 are shown in Table 5. It is seen that the Nd+Pr+Tb content is greater than $R^1_{min}$.

Using a diamond grinding tool, magnet block M5 was machined on all the surfaces into a magnet body having dimensions of 20×20×4 mm. It was washed in sequence with alkaline solution, deionized water, nitric acid and deionized water, and dried.

Subsequently, dysprosium oxyfluoride having an average particle size of 1.5 μm was mixed with deionized water at a weight fraction of 40% to form a suspension, in which the magnet body was immersed for 30 seconds with ultrasonic waves being applied. The magnet body was pulled up and immediately dried with a hot air blow. At this point, the dysprosium oxyfluoride surrounded the magnet body and occupied a magnet surface-surrounding space at a filling factor of 45% by volume.

The magnet body covered with dysprosium oxyfluoride was subjected to absorption treatment in an argon atmosphere at 850° C. for 12 hours. It was then subjected to aging treatment at 490° C. for one hour, and quenched, obtaining a magnet designated M5-A. For evaluating an increase of coercive force by grain boundary diffusion treatment, a magnet was prepared by subjecting a similar magnet body to heat treatment in the absence of dysprosium oxyfluoride and aging treatment (i.e., without absorption treatment). It is designated magnet M5-B. For magnets M5-A and M5-B, the coercive force and the increment of coercive force by grain boundary diffusion are shown in Table 5. It is seen that the grain boundary diffusion treatment increased the coercive force by 398 kA/m.

Comparative Example 5

A mother alloy in thin plate form was prepared with the same composition and under the same conditions as in Example 5. Under the same conditions as in Example 5, the mother alloy was pulverized into a coarse powder under 50 mesh. This coarse powder was subjected to partial nitriding treatment in a nitrogen atmosphere at 200° C. for 4 hours. The nitrided coarse powder was finely pulverized, compacted under a magnetic field, and sintered under the same conditions as in Example 5, yielding a sintered magnet block P5. The composition and the required minimum content ($R^1_{min}$) of block P5 are shown in Table 5. It is seen that the Nd+Pr+Tb content is less than $R^1_{min}$.

As in Example 5, magnet block P5 was machined and subjected to grain boundary diffusion treatment and aging treatment. It is designated magnet P5-A. For evaluating an increase of coercive force by grain boundary diffusion treatment, a magnet was prepared by subjecting a similar magnet body to heat treatment in the absence of dysprosium oxyfluoride and aging treatment (i.e., without absorption treatment). It is designated magnet P5-B. For magnets P5-A and P5-B, the coercive force and the increment of coercive force by grain boundary diffusion are shown in Table 5. It is seen that the grain boundary diffusion treatment increased the coercive force by only 144 kA/m.

TABLE 5

| | | Example 5 M5 | Comparative Example 5 P5 |
|---|---|---|---|
| Composition of original magnet (atom %) | $R^1$ | 13.16 | 13.16 |
| | T | 79.71 | 77.19 |
| | B | 6.01 | 5.82 |
| | M | 0.40 | 0.39 |
| | O | 0.63 | 0.62 |
| | C | 0.40 | 0.40 |
| | N | 0.10 | 0.95 |
| | $R^1_{min}$ | 12.60 | 13.18 |
| Coercive force (kA/m) | A (absorption treatment) | 1512 | 1218 |
| | B (no absorption treatment) | 1114 | 1074 |
| | Increment by boundary diffusion | 398 | 144 |

Example 6

A mother alloy in thin plate form was prepared by a strip casting technique, specifically by weighing Nd, Al, Fe and Cu metals having a purity of at least 99% by weight and ferroboron, high-frequency heating in an argon atmosphere for melting, and casting the alloy melt on a copper single roll. The mother alloy consisted of 13.4 atom % of Nd, 0.2 atom % of Al, 0.2 atom % of Cu, 7.0 atom % of B, and the balance of Fe. Hydriding pulverization was carried out by exposing the alloy to 0.11 MPa of hydrogen at room temperature to occlude hydrogen and then heating at 500° C. for partial dehydriding while evacuating to vacuum. The pulverized alloy was cooled and sieved, yielding a coarse powder under 50 mesh.

Subsequently, the coarse powder was finely pulverized on a jet mill using high-pressure nitrogen gas into a fine powder having a mass median particle diameter of 5.0 μm. The fine powder was compacted in a nitrogen atmosphere under a pressure of about 100 MPa while being oriented in a magnetic field of 1.2 MA/m. The green compact was then placed in a sintering furnace with an argon atmosphere where it was sintered at 1,060° C. for 2 hours, obtaining a sintered magnet block M6. The composition and the required minimum content ($R^1_{min}$) of block M6 are shown in Table 6. It is seen that the Nd content is greater than $R^1_{min}$.

Using a diamond grinding tool, magnet block M6 was machined on all the surfaces into a magnet body having dimensions of 7×7×5 mm. It was washed in sequence with alkaline solution, deionized water, nitric acid and deionized water, and dried.

Subsequently, dysprosium fluoride and neodymium oxide having an average particle size of 2.0 μm and 1.0 μm, respectively, were mixed in a weight ratio of 60:40 to form a powder mixture. It was mixed with ethanol at a weight fraction of 50% to form a suspension, in which the magnet body was immersed for 30 seconds with ultrasonic waves being applied. The magnet body was pulled up and placed in a vacuum desiccator where it was dried for 30 minutes at room temperature in an atmosphere evacuated by a rotary pump. At this point, the powder mixture surrounded the magnet body and occupied a magnet surface-surrounding space at a filling factor of 50% by volume.

The magnet body covered with the powder mixture was subjected to absorption treatment in an argon atmosphere at 850° C. for 8 hours. It was then subjected to aging treatment at 530° C. for one hour, and quenched, obtaining a magnet, designated M6-A. For evaluating an increase of coercive force by grain boundary diffusion treatment, a magnet was prepared by subjecting a similar magnet body to heat treatment in the absence of the powder mixture and aging treatment (i.e., without absorption treatment). It is designated magnet M6-B. For magnets M6-A and M6-B, the coercive force and the increment of coercive force by grain boundary diffusion are shown in Table 6. It is seen that the grain boundary diffusion treatment increased the coercive force by 477 kA/m.

Comparative Example 6

A mother alloy in thin plate form was prepared by a strip casting technique, specifically by weighing Nd, Al, Fe and Cu metals having a purity of at least 99% by weight and ferroboron, high-frequency heating in an argon atmosphere for melting, and casting the alloy melt on a copper single roll. The mother alloy consisted of 13.4 atom % of Nd, 0.2 atom % of Al, 0.2 atom % of Cu, 5.8 atom % of B, and the balance of Fe. This mother alloy composition has a boron content which is 1.2 atom % lower than that of Example 6 (an iron content of 1.2 atom % greater). This mother alloy was pulverized, compacted, and sintered as in Example 6, obtaining a sintered magnet block P6. The composition and the required minimum content ($R^1_{min}$) of magnet block P6 are shown in Table 6. It is seen that the Nd content is less than $R^1_{min}$.

As in Example 6, magnet block P6 was machined and subjected to grain boundary diffusion treatment and aging treatment. It is designated magnet P6-A. For evaluating an increase of coercive force by grain boundary diffusion treatment, a magnet was prepared by subjecting a similar magnet body to heat treatment in the absence of the powder mixture and aging treatment (i.e., without absorption treatment). It is designated magnet P6-B. For magnets P6-A and P6-B, the coercive force and the increment of coercive force by grain boundary diffusion are shown in Table 6. It is seen that the grain boundary diffusion treatment increased the coercive force by only 278 kA/m.

TABLE 6

| | | Example 6 M6 | Comparative Example 6 P6 |
|---|---|---|---|
| Composition of original magnet (atom %) | $R^1$ | 12.53 | 12.53 |
| | T | 79.06 | 80.32 |
| | B | 6.99 | 5.79 |
| | M | 0.40 | 0.40 |
| | O | 0.68 | 0.66 |
| | C | 0.35 | 0.35 |
| | N | 0.03 | 0.04 |
| | $R^1_{min}$ | 12.44 | 12.57 |
| Coercive force (kA/m) | A (absorption treatment) | 1464 | 1249 |
| | B (no absorption treatment) | 987 | 971 |
| | Increment by boundary diffusion | 477 | 278 |

Example 7

A mother alloy in thin plate form was prepared by a strip casting technique, specifically by weighing Nd, Fe, Co, Zn, In, Ti, V, Cr, Mn, Ni, Ga, Ge, Zr, Nb, Mo, Pd, Ag, Cd, Sn, Sb, Hf, Ta, and W metals having a purity of at least 99% by weight, ferroalloys of V, B and P, Si, and S, high-frequency heating in an argon atmosphere for melting, and casting the alloy melt on a copper single roll. The mother alloy consisted of 14.0 atom % of Nd, 2.0 atom % of Co, 6.2 atom % of B, 0.4 atom % of M (wherein M is selected from the group consisting of Zn, In, Si, P, S, Ti, V, Cr, Mn, Ni, Ga, Ge, Zr, Nb, Mo, Pd. Ag, Cd, Sn, Sb, Hf, Ta, and W), and the balance of Fe. Hydriding pulverization was carried out by exposing the alloy to 0.11 MPa of hydrogen at room temperature to occlude hydrogen and then heating at 500° C. for partial dehydriding while evacuating to vacuum. The pulverized alloy was cooled and sieved, yielding a coarse powder under 50 mesh.

Subsequently, the coarse powder was finely pulverized on a jet mill using high-pressure nitrogen gas into a fine powder having a mass median particle diameter of 5.0±0.4 μm. The fine powder was compacted in a nitrogen atmosphere under a pressure of about 100 MPa while being oriented in a magnetic field of 1.2 MA/m. The green compact was then placed in a sintering furnace with an argon atmosphere where it was sintered at 1,060° C. for 2 hours. In this way, sintered magnet blocks M7-1 to 23 were obtained. Note that blocks M7-1 to 23 correspond to the additive element selected from the group consisting of Zn, In, Si, P, S, Ti, V, Cr, Mn, Ni, Ga, Ge, Zr, Nb, Mo, Pd, Ag, Cd, Sn, Sb, Hf, Ta, and W in the described order. The composition and the required minimum content ($R^1_{min}$) of blocks M7-1 to 23 are shown in Tables 7 to 10. It is seen that in all runs, the Nd content is greater than $R^1_{min}$.

Using a diamond grinding tool, each of magnet blocks M7-1 to 23 was machined on all the surfaces into a magnet body having dimensions of 7×7×7 mm. It was washed in sequence with alkaline solution, deionized water, nitric acid and deionized water, and dried.

Subsequently, dysprosium fluoride powder having an average particle size of 2.5 μm was mixed with ethanol at a weight fraction of 50% to form a suspension, in which the magnet body was immersed for 30 seconds with ultrasonic waves being applied. The magnet body was pulled up and placed in a vacuum desiccator where it was dried for 30 minutes at room temperature in an atmosphere evacuated by a rotary pump. At this point, the dysprosium fluoride surrounded the magnet body and occupied a magnet surface-surrounding space at a filling factor of 45% by volume.

The magnet body covered with dysprosium fluoride was subjected to absorption treatment in an argon atmosphere at 800° C. for 15 hours. It was then subjected to aging treatment at 500° C. for one hour, and quenched. In this way, there were obtained magnets, designated M7-1-A to M7-23-A. For evaluating an increase of coercive force by grain boundary diffusion treatment, a series of magnets were prepared by subjecting similar magnet bodies to heat treatment in the absence of dysprosium fluoride and aging treatment (i.e., without absorption treatment). They are designated magnets M7-1-B to M7-23-B. For magnets M7-1-A to M7-23-A and M7-1-B to M7-23-B, the coercive force and the increment of coercive force by grain boundary diffusion are shown in Tables 7 to 10. It is seen that the grain boundary diffusion treatment increased the coercive force by 398 to 637 kA/m.

TABLE 7

| | | Example 7 | | | | | |
|---|---|---|---|---|---|---|---|
| | | M7-1 | M7-2 | M7-3 | M7-4 | M7-5 | M7-6 |
| Composition of original magnet (atom %) | $R^1$ | 13.16 | 13.25 | 13.32 | 13.04 | 13.25 | 13.19 |
| | T | 79.33 | 79.51 | 79.19 | 79.35 | 79.48 | 79.06 |
| | B | 6.19 | 6.19 | 6.14 | 6.24 | 6.25 | 6.17 |
| | M | Zn | In | Si | P | S | Ti |
| | | 0.30 | 0.25 | 0.45 | 0.33 | 0.15 | 0.41 |
| | O | 0.65 | 0.80 | 0.84 | 0.79 | 0.84 | 0.66 |
| | C | 0.29 | 0.39 | 0.39 | 0.29 | 0.29 | 0.29 |
| | N | 0.15 | 0.10 | 0.02 | 0.04 | 0.12 | 0.02 |
| | $R^1_{min}$ | 12.55 | 12.68 | 12.66 | 12.56 | 12.65 | 12.47 |
| Coercive force (kA/m) | A (absorption treatment) | 1345 | 1361 | 1401 | 1329 | 1377 | 1393 |
| | B (no absorption treatment) | 947 | 963 | 995 | 923 | 947 | 939 |
| | Increment by boundary diffusion | 398 | 398 | 406 | 406 | 430 | 454 |

TABLE 8

| | | Example 7 | | | | | |
|---|---|---|---|---|---|---|---|
| | | M7-7 | M7-8 | M7-9 | M7-10 | M7-11 | M7-12 |
| Composition of original magnet (atom %) | $R^1$ | 13.21 | 13.17 | 13.19 | 13.30 | 13.22 | 13.21 |
| | T | 79.16 | 79.35 | 79.25 | 79.10 | 79.18 | 79.23 |
| | B | 6.13 | 6.09 | 6.19 | 6.18 | 6.18 | 6.18 |
| | M | V | Cr | Mn | Ni | Ga | Ge |
| | | 0.40 | 0.39 | 0.36 | 0.40 | 0.40 | 0.40 |
| | O | 0.70 | 0.78 | 0.75 | 0.75 | 0.79 | 0.81 |
| | C | 0.28 | 0.29 | 0.30 | 0.30 | 0.30 | 0.29 |
| | N | 0.03 | 0.04 | 0.06 | 0.03 | 0.04 | 0.06 |
| | $R^1_{min}$ | 12.50 | 12.57 | 12.56 | 12.54 | 12.58 | 12.60 |
| Coercive force (kA/m) | A (absorption treatment) | 1552 | 1488 | 1424 | 1337 | 1687 | 1456 |
| | B (no absorption treatment) | 979 | 987 | 955 | 923 | 1050 | 995 |
| | Increment by boundary diffusion | 573 | 501 | 469 | 414 | 637 | 461 |

TABLE 9

| | | Example 7 | | | | | |
|---|---|---|---|---|---|---|---|
| | | M7-13 | M7-14 | M7-15 | M7-16 | M7-17 | M7-18 |
| Composition of original magnet (atom %) | $R^1$ | 13.16 | 13.14 | 13.16 | 13.30 | 13.22 | 13.26 |
| | T | 79.22 | 79.30 | 79.19 | 79.09 | 79.39 | 79.31 |
| | B | 6.19 | 6.09 | 6.18 | 6.18 | 6.23 | 6.24 |
| | M | Zr | Nb | Mo | Pd | Ag | Cd |
| | | 0.40 | 0.41 | 0.40 | 0.40 | 0.37 | 0.26 |
| | O | 0.72 | 0.70 | 0.69 | 0.75 | 0.62 | 0.61 |
| | C | 0.27 | 0.32 | 0.31 | 0.22 | 0.53 | 0.43 |
| | N | 0.09 | 0.04 | 0.05 | 0.08 | 0.20 | 0.18 |
| | $R^1_{min}$ | 12.54 | 12.54 | 12.52 | 12.52 | 12.72 | 12.63 |
| Coercive force (kA/m) | A (absorption treatment) | 1576 | 1552 | 1504 | 1480 | 1528 | 1504 |
| | B (no absorption treatment) | 1003 | 979 | 995 | 1027 | 1003 | 939 |
| | Increment by boundary diffusion | 573 | 573 | 509 | 453 | 525 | 565 |

TABLE 10

| | | Example 7 | | | | |
|---|---|---|---|---|---|---|
| | | M7-19 | M7-20 | M7-21 | M7-22 | M7-23 |
| Composition of original magnet (atom %) | $R^1$ | 13.30 | 13.31 | 13.09 | 13.30 | 13.21 |
| | T | 79.24 | 79.49 | 78.99 | 79.10 | 79.11 |
| | B | 6.19 | 6.11 | 6.17 | 6.18 | 6.17 |
| | M | Sn | Sb | Hf | Ta | W |
| | | 0.40 | 0.41 | 0.40 | 0.40 | 0.40 |
| | O | 0.65 | 0.76 | 0.62 | 0.72 | 0.81 |
| | C | 0.25 | 0.32 | 0.19 | 0.24 | 0.32 |
| | N | 0.06 | 0.12 | 0.09 | 0.11 | 0.04 |
| | $R^1_{min}$ | 12.46 | 12.63 | 12.42 | 12.54 | 12.61 |
| Coercive force (kA/m) | A (absorption treatment) | 1448 | 1353 | 1544 | 1576 | 1480 |
| | B (no absorption treatment) | 1003 | 955 | 995 | 971 | 987 |
| | Increment by boundary diffusion | 445 | 398 | 549 | 605 | 493 |

Example 8

A mother alloy in thin plate form was prepared by a strip casting technique, specifically by weighing Nd, Al, Fe and Cu metals having a purity of at least 99% by weight and ferroboron, high-frequency heating in an argon atmosphere for melting, and casting the alloy melt on a copper single roll. The mother alloy consisted of 14.2 atom % of Nd, 0.5 atom % of Al, 0.1 atom % of Cu, 6.0 atom % of B, and the balance of Fe. Hydriding pulverization was carried out by exposing the alloy to 0.11 MPa of hydrogen at room temperature to occlude hydrogen and then heating at 500° C. for partial dehydriding while evacuating to vacuum. The pulverized alloy was cooled and sieved, yielding a coarse powder under 50 mesh.

Subsequently, the coarse powder was finely pulverized on a jet mill using high-pressure nitrogen gas into a fine powder having a mass median particle diameter of 6.0 μm. The fine powder was compacted in a nitrogen atmosphere under a pressure of about 100 MPa while being oriented in a magnetic field of 1.2 MA/m. The green compact was then placed in a sintering furnace with an argon atmosphere where it was sintered at 1,060° C. for 2 hours, obtaining a sintered magnet block M8. The composition and the required minimum content ($R^1_{min}$) of block M8 are shown in Table 11. It is seen that the Nd content is greater than $R^1_{min}$.

Using a diamond grinding tool, magnet block M8 was machined on all the surfaces into a magnet body having dimensions of 10×10×5 mm. It was washed in sequence with alkaline solution, deionized water, nitric acid and deionized water, and dried.

Subsequently, a powder mixture consisting of 3 wt % of dysprosium carbide, 2 wt % of dysprosium nitride, 10 wt % of dysprosium boride, 5 wt % of dysprosium silicide, 12 wt % of neodymium hydroxide, 8 wt % of praseodymium hydride, and the balance of dysprosium fluoride was prepared. These powders had an average particle size ranging from 0.5 μm to 5.5 μm. The powder mixture was mixed with ethanol at a weight fraction of 50% to form a suspension, in which the magnet body was immersed for 30 seconds with ultrasonic waves being applied. The magnet body was pulled up and immediately dried with a hot air blow. At this point, the powder mixture surrounded the magnet body and occupied a magnet surface-surrounding space at a filling factor of 85% by volume.

The magnet body covered with the powder mixture was subjected to absorption treatment in an argon atmosphere at 800° C. for 20 hours. It was then subjected to aging treatment at 530° C. for one hour, and quenched, obtaining a magnet designated M8-A. For evaluating an increase of coercive force by grain boundary diffusion treatment, a magnet was prepared by subjecting a similar magnet body to heat treatment in the absence of the powder mixture and aging treatment (i.e., without absorption treatment). It is designated magnet M8-B. For magnets M8-A and M8-B, the coercive force and the increment of coercive force by grain boundary diffusion are shown in Table 11. It is seen that the grain boundary diffusion treatment increased the coercive force by 676 kA/m.

Example 9

A mother alloy in thin plate form was prepared by a strip casting technique, specifically by weighing Nd, Pr, Dy, Al, Fe and Cu metals having a purity of at least 99% by weight and ferroboron, high-frequency heating in an argon atmosphere for melting, and casting the alloy melt on a copper single roll. The mother alloy consisted of 12.0 atom % of Nd, 1.0 atom % of Pr, 1.0 atom % of Dy, 0.2 atom % of Al, 0.1 atom % of Cu, 5.8 atom % of B, and the balance of Fe. Hydriding pulverization was carried out by exposing the alloy to 0.11 MPa of hydrogen at room temperature to occlude hydrogen and then heating at 500° C. for partial dehydriding while evacuating to vacuum. The pulverized alloy was cooled and sieved, yielding a coarse powder under 50 mesh.

Subsequently, the coarse powder was finely pulverized on a jet mill using high-pressure nitrogen gas into a fine powder having a mass median particle diameter of 4.5 μm. The fine powder was compacted in a nitrogen atmosphere under a pressure of about 100 MPa while being oriented in a magnetic field of 1.2 MA/m. The green compact was then placed in a sintering furnace with an argon atmosphere where it was sintered at 1,060° C. for 2 hours, obtaining a sintered magnet block M9. The composition and the required minimum content ($R^1_{min}$) of block M9 are shown in Table 11. It is seen that the Nd+Pr+Dy content is greater than $R^1_{min}$.

Using a diamond grinding tool, magnet block M9 was machined on all the surfaces into a magnet body having dimensions of 20×20×5 mm. It was washed in sequence with alkaline solution, deionized water, nitric acid and deionized water, and dried.

Subsequently, terbium fluoride, neodymium fluoride, and praseodymium fluoride having an average particle size of 1.5 Ar, 4.5 μm, and 3.0 μm, respectively, were mixed in a weight ratio of 60:20:20 to form a powder mixture. It was mixed with deionized water at a weight fraction of 50% to form a suspension, in which the magnet body was immersed for 30 seconds with ultrasonic waves being applied. The magnet body was pulled up and immediately dried with a hot air blow. At this point, the powder mixture surrounded the magnet body and occupied a magnet surface-surrounding space at a filling factor of 50% by volume.

The magnet body covered with the powder mixture was subjected to absorption treatment in an argon atmosphere at 800° C. for 15 hours.

The magnet body was subjected to heat treatment again under the same conditions as above while the magnet body surface was covered with the powder mixture under the same conditions as above. The magnet body having undergone two grain boundary diffusion treatments was then subjected to aging treatment at 470° C. for one hour, and quenched, obtaining a magnet designated M9-A. For evaluating an increase of coercive force by grain boundary diffusion treatment, a magnet was prepared by subjecting a similar magnet body to heat treatment in the absence of the powder mixture and aging treatment (i.e., without absorption treatment). It is designated magnet M9-B. For magnets M9-A and M9-B, the coercive force and the increment of coercive force by grain boundary diffusion are shown in Table 11. It is seen that the grain boundary diffusion treatment increased the coercive force by 716 kA/m.

With respect to the rare earth elements in the powder mixture, Tb accounts for 60 wt % and Nd+Pr (the sum of Nd and Pr) accounts for 40 wt % of the entire rare earth elements. For the reason that this Nd+Pr content is extremely lower than the proportion (−90 wt %) of Nd+Pr (the sum of Nd and Pr) relative to the rare earth elements in magnet M9 and that the powder mixture has a higher Tb concentration as compared with the sintered magnet body (M9 does not contain Tb), Tb is efficiently absorbed within the sintered magnet body. As a result, an effect of increasing coercive force was accomplished.

TABLE 11

| | | Example 8 M8 | Example 9 M9 |
|---|---|---|---|
| Composition of original magnet (atom %) | $R^1$ | 13.28 | 13.09 |
| | T | 79.08 | 80.33 |
| | B | 5.99 | 5.76 |
| | M | 0.60 | 0.30 |
| | O | 0.53 | 0.30 |
| | C | 0.32 | 0.29 |
| | N | 0.21 | 0.15 |
| | $R^1_{min}$ | 12.55 | 12.36 |
| Coercive force (kA/m) | A (absorption treatment) | 1623 | 1822 |
| | B (no absorption treatment) | 947 | 1106 |
| | Increment by boundary diffusion | 676 | 716 |

Example 10 and Comparative Example 10

A mother alloy in thin plate form was prepared by a strip casting technique, specifically by weighing Nd, Dy, Al, Fe and Cu metals having a purity of at least 99% by weight and ferroboron, high-frequency heating in an argon atmosphere for melting, and casting the alloy melt on a copper single roll. The mother alloy consisted of 13.5 atom % of Nd, 1.5 atom % of Dy, 0.2 atom % of Al, 0.2 atom % of Cu, 5.9 atom % of B, and the balance of Fe. Hydriding pulverization was carried out by exposing the alloy to 0.11 MPa of hydrogen at room temperature to occlude hydrogen and then heating at 500° C. for partial dehydriding while evacuating to vacuum. The pulverized alloy was cooled and sieved, yielding a coarse powder under 50 mesh. Additionally, the coarse powder was subjected to partial carbonizing treatment in acetylene gas at a temperature of 50° C., 100° C., 150° C. or 200° C. for 4 hours, obtaining carbonized coarse powders.

Subsequently, each of the coarse powders was finely pulverized on a jet mill using high-pressure nitrogen gas into a fine powder having a mass median particle diameter of 5.0 μm. The fine powder was compacted in a nitrogen atmosphere under a pressure of about 100 MPa while being oriented in a magnetic field of 1.2 MA/m. The green compact was then placed in a sintering furnace with an argon atmosphere where it was sintered at 1,060° C. for 2 hours. In this way, there were obtained sintered magnet blocks which are designated M10-1 corresponding to the original coarse powder, and M10-2, M10-3, P10-1, and P10-2 corresponding to the carbonizing temperature of 50° C., 100° C., 150° C., and 200° C. The composition and the required minimum content ($R^1_{min}$) of blocks M10-1 to 3 and P10-1 and 2 are shown in Table 12. It is seen that the Nd+Dy content in blocks M10-1 to 3 is greater than $R^1_{min}$ whereas the Nd+Dy content in blocks P10-1 and 2 is less than $R^1_{min}$.

Using a diamond grinding tool, each of magnet blocks M10-1 to 3 and P10-1 and 2 was machined on all the surfaces into a magnet body having dimensions of 40×20×4 mm. It was washed in sequence with alkaline solution, deionized water, nitric acid and deionized water, and dried.

Subsequently, dysprosium fluoride and lanthanum hydroxide having an average particle size of 2.0 μm and 1.0 μm, respectively, were mixed in a weight ratio of 90:10 to from a powder mixture. It was mixed with deionized water at a weight fraction of 50% to form a suspension, in which the magnet body was immersed for 30 seconds with ultrasonic waves being applied. The magnet body was pulled up and immediately dried with a hot air blow. At this point, the powder mixture surrounded the magnet body and occupied a magnet surface-surrounding space at a filling factor of 65% by volume.

The magnet body covered with the powder mixture was subjected to absorption treatment in an argon atmosphere at 820° C. for 14 hours. It was then subjected to aging treatment at 510° C. for one hour, and quenched. In this way, there were obtained magnets designated M10-1-A to M10-3-A, P10-1-A and P10-2-A. For evaluating an increase of coercive force by grain boundary diffusion treatment, magnets were prepared by subjecting similar magnet bodies to heat treatment in the absence of the powder mixture and aging treatment (i.e., without absorption treatment). They are designated magnets M10-1-B to M10-3-B, P10-1-B and P10-2-B. For these magnets, the coercive force and the increment of coercive force by grain boundary diffusion are shown in Table 12. It is seen that in magnets M10-1-A to M10-3-A having a Nd+Dy content in excess of $R^1_{min}$, the grain boundary diffusion treatment increased the coercive force by at least 310 kA/m. In magnets P10-1-A and P10-2-A having a Nd+Dy content below $R^1_{min}$, the grain boundary diffusion treatment increased the coercive force by only 143 or 120 kA/m.

TABLE 12

| | | Example 10 | | | Comparative Example 10 | |
|---|---|---|---|---|---|---|
| | | M10-1 | M10-2 | M10-3 | P10-1 | P10-2 |
| Composition of original magnet (atom %) | $R^1$ | 14.10 | 14.12 | 14.09 | 14.07 | 14.13 |
| | T | 78.38 | 77.61 | 76.98 | 76.37 | 76.14 |
| | B | 5.88 | 5.82 | 5.77 | 5.73 | 5.71 |
| | M | 0.40 | 0.39 | 0.39 | 0.39 | 0.39 |
| | O | 0.68 | 0.67 | 0.68 | 0.67 | 0.66 |
| | C | 0.35 | 1.24 | 1.85 | 2.53 | 2.85 |
| | N | 0.21 | 0.20 | 0.22 | 0.22 | 0.21 |
| | $R^1_{min}$ | 12.68 | 13.27 | 13.71 | 14.16 | 14.36 |
| Coercive force (kA/m) | A (absorption treatment) | 1512 | 1504 | 1472 | 1273 | 1218 |
| | B (no absorption treatment) | 1194 | 1194 | 1162 | 1130 | 1098 |
| | Increment by boundary diffusion | 318 | 310 | 310 | 143 | 120 |

Example 11 and Comparative Example 11

A mother alloy in thin plate form was prepared by a strip casting technique, specifically by weighing Nd, Al, Fe and Cu metals having a purity of at least 99% by weight and ferroboron, high-frequency heating in an argon atmosphere for melting, and casting the alloy melt on a copper single roll. The mother alloy consisted of 15.0 atom % of Nd, 0.2 atom % of Al, 0.2 atom % of Cu, 6.0 atom % of B, and the balance of Fe. Hydriding pulverization was carried out by exposing the alloy to 0.11 MPa of hydrogen at room temperature to occlude hydrogen and then heating at 500° C. for partial dehydriding while evacuating to vacuum. The pulverized alloy was cooled and sieved, yielding a coarse powder under 50 mesh.

Subsequently, the coarse powder was finely pulverized on a jet mill using high-pressure nitrogen gas into a fine powder having a mass median particle diameter of 5.2 μm. The fine powder was held in air at room temperature for 0, 24, 48, 72, and 96 hours, during which it was slowly oxidized. Each of the (non-oxidized or oxidized) fine powders was compacted under a pressure of about 100 MPa while being oriented in a magnetic field of 1.2 MA/m. The green compact was then placed in a sintering furnace with an argon atmosphere where it was sintered at 1,060° C. for 2 hours. In this way, there were obtained sintered magnet blocks which are designated M11-1, M11-2, M11-3, P11-1, and P11-2 corresponding to the slow oxidizing time of 0, 24, 48, 72, and 96 hours. The composition and the required minimum content ($R^1_{min}$) of blocks M11-1 to 3 and P11-1 and 2 are shown in Table 13. It is seen that the Nd content in blocks M11-1 to 3 is greater than $R^1_{min}$ whereas the Nd content in blocks P11-1 and 2 is less than $R^1_{min}$.

Using a diamond grinding tool, each of magnet blocks M11-1 to 3 and P11-1 and 2 was machined on all the surfaces into a magnet body having dimensions of 20×20×3 mm. It was washed in sequence with alkaline solution, deionized water, nitric acid and deionized water, and dried.

Subsequently, terbium fluoride having an average particle size of 2.3 μm was mixed with deionized water at a weight fraction of 50% to form a suspension, in which the magnet body was immersed for 30 seconds with ultrasonic waves being applied. The magnet body was pulled up and immediately dried with a hot air blow. At this point, the terbium fluoride surrounded the magnet body and occupied a magnet surface-surrounding space at a filling factor of 40% by volume.

The magnet body covered with the terbium fluoride was subjected to absorption treatment in an argon atmosphere at 850° C. for 10 hours. It was then subjected to aging treatment at 530° C. for one hour, and quenched. In this way, there were obtained magnets designated M11-1-A to M11-3-A, P11-1-A and P11-2-A. For evaluating an increase of coercive force by grain boundary diffusion treatment, magnets were prepared by subjecting similar magnet bodies to heat treatment in the absence of the terbium fluoride and aging treatment (i.e., without absorption treatment). They are designated magnets M11-1-B to M11-3-B, P11-1-B and P11-2-B. For these magnets, the coercive force and the increment of coercive force by grain boundary diffusion are shown in Table 13. It is seen that in magnets M11-1-A to M11-3-A having a Nd content in excess of $R^1_{min}$, the grain boundary diffusion treatment increased the coercive force by at least 533 kA/m. In magnets P11-1-A and P11-2-A having a Nd content below $R^1$ min, the grain boundary diffusion treatment increased the coercive force by only 262 or 103 kA/m.

TABLE 13

| | | Example 11 | | | Comparative Example 11 | |
|---|---|---|---|---|---|---|
| | | M11-1 | M11-2 | M11-3 | P11-1 | P11-2 |
| Composition of original magnet (atom %) | $R^1$ | 14.43 | 14.45 | 14.43 | 14.45 | 14.43 |
| | T | 77.97 | 77.09 | 76.05 | 75.45 | 74.23 |
| | B | 5.95 | 5.88 | 5.81 | 5.76 | 5.67 |
| | M | 0.40 | 0.39 | 0.39 | 0.38 | 0.38 |
| | O | 0.62 | 1.57 | 2.70 | 3.36 | 3.75 |
| | C | 0.54 | 0.53 | 0.55 | 0.56 | 0.54 |
| | N | 0.10 | 0.08 | 0.09 | 0.08 | 1.00 |
| | $R^1_{min}$ | 12.69 | 13.31 | 14.10 | 14.55 | 15.42 |
| Coercive force (kA/m) | A (absorption treatment) | 1592 | 1552 | 1520 | 1241 | 1066 |
| | B (no absorption treatment) | 995 | 995 | 987 | 979 | 963 |
| | Increment by boundary diffusion | 597 | 557 | 533 | 262 | 103 |

Example 12 and Comparative Example 12

Mother alloys in thin plate form were prepared by a strip casting technique, specifically by weighing Nd, Pr, Al, Fe and Cu metals having a purity of at least 99% by weight and ferroboron, high-frequency heating in an argon atmosphere for melting, and casting the alloy melt on a copper single roll. The mother alloys consisted of 13.0 atom % of Nd, 1.0 atom % of Pr, 0.2 atom % of Al, 0.2 atom % of Cu, 11.0, 10.0, 9.0, 8.0, 7.0, 6.0 or 5.0 atom % of B, and the balance of Fe. Hydriding pulverization was carried out by exposing each alloy to 0.11 MPa of hydrogen at room temperature to occlude hydrogen and then heating at 500° C. for partial dehydriding while evacuating to vacuum. The pulverized alloy was cooled and sieved, yielding a coarse powder under 50 mesh.

Subsequently, each of the coarse powders was finely pulverized on a jet mill using high-pressure nitrogen gas into a fine powder having a mass median particle diameter of 4.8 to 5.2 μm. The fine powder was compacted under a pressure of about 100 MPa while being oriented in a magnetic field of 1.2 MA/m. The green compact was then placed in a sintering furnace with an argon atmosphere where it was sintered at 1,060° C. for 2 hours. In this way, there were obtained sintered magnet blocks which are designated M12-1, M12-2, M12-3, M12-4, P12-1, P12-2, and P12-3 corresponding to the mother alloy's boron content of 11.0, 10.0, 9.0, 8.0, 7.0, 6.0 or 5.0 atom %. The composition and the required minimum content ($R^1_{min}$) of blocks M12-1 to 4 are shown in Table 14, and the composition and $R^1_{min}$ of blocks P12-1 to 3 are shown in Table 15. It is seen that the Nd+Pr content in blocks M12-1 to 4 is greater than $R^1$ min whereas the Nd+Pr content in blocks P12-1 to 3 is less than $R^1_{min}$.

Using a diamond grinding tool, each of magnet blocks M12-1 to 4 and P12-1 to 3 was machined on all the surfaces into a magnet body having dimensions of 10×20×3.5 mm. It was washed in sequence with alkaline solution, deionized water, nitric acid and deionized water, and dried.

Subsequently, dysprosium fluoride having an average particle size of 2.0 μm was mixed with deionized water at a weight fraction of 50% to form a suspension, in which the magnet body was immersed for 30 seconds with ultrasonic waves being applied. The magnet body was pulled up and immediately dried with a hot air blow. At this point, the dysprosium fluoride surrounded the magnet body and occupied a magnet surface-surrounding space at a filling factor of 45% by volume.

The magnet body covered with the dysprosium fluoride was subjected to absorption treatment in an argon atmosphere at 820° C. for 12 hours. It was then subjected to aging treatment at 490° C. for one hour, and quenched. In this way, there were obtained magnets designated M12-1-A to M12-4-A, P12-1-A to P12-3-A. For evaluating an increase of coercive force by grain boundary diffusion treatment, magnets were prepared by subjecting similar magnet bodies to heat treatment in the absence of dysprosium fluoride and aging treatment (i.e., without absorption treatment). They are designated magnets M12-1-B to M12-4-B and P12-1-B to P12-3-B. For magnets M12-1-A to M12-4-A and M12-1-B to M12-4-B, the coercive force and the increment of coercive force by grain boundary diffusion are shown in Table 14. For magnets P12-1-A to P12-3-A and P12-1-B to P12-3-B, the coercive force and the increment of coercive force by grain boundary diffusion are shown in Table 15. It is seen that in magnets M12-1-A to M12-4-A having a Nd+Pr content in excess of $R^1_{min}$, the grain boundary diffusion treatment increased the coercive force by at least 310 kA/m. In magnets P12-1-A to P12-3-A having a Nd+Pr content below $R^1_{min}$, the grain boundary diffusion treatment increased the coercive force by only 215, 151 or 159 kA/m.

TABLE 14

| | | Example 12 | | | |
|---|---|---|---|---|---|
| | | M12-1 | M12-2 | P12-3 | P12-4 |
| Composition of original magnet (atom %) | $R^1$ | 13.08 | 13.09 | 13.10 | 13.08 |
| | T | 73.66 | 74.67 | 75.69 | 76.67 |
| | B | 10.86 | 9.88 | 8.89 | 7.90 |
| | M | 0.39 | 0.40 | 0.40 | 0.40 |
| | O | 1.30 | 1.33 | 1.33 | 1.34 |
| | C | 0.44 | 0.44 | 0.45 | 0.46 |
| | N | 0.26 | 0.25 | 0.26 | 0.26 |
| | $R^1_{min}$ | 12.65 | 12.77 | 12.89 | 13.01 |
| Coercive force (kA/m) | A (absorption treatment) | 1353 | 1337 | 1321 | 1321 |
| | B (no absorption treatment) | 1035 | 1011 | 1011 | 1003 |
| | Increment by boundary diffusion | 318 | 326 | 310 | 318 |

TABLE 15

| | | Comparative Example 12 | | |
|---|---|---|---|---|
| | | P12-1 | P12-2 | P12-3 |
| Composition of original magnet (atom %) | $R^1$ | 13.09 | 13.08 | 13.09 |
| | T | 77.66 | 78.60 | 79.65 |
| | B | 6.92 | 5.92 | 4.94 |
| | M | 0.40 | 0.39 | 0.40 |
| | O | 1.35 | 1.32 | 1.34 |
| | C | 0.45 | 0.45 | 0.46 |
| | N | 0.25 | 0.24 | 0.26 |
| | $R^1_{min}$ | 13.11 | 13.20 | 13.34 |
| Coercive force (kA/m) | A (absorption treatment) | 1210 | 1122 | 1098 |
| | B (no absorption treatment) | 995 | 971 | 939 |
| | Increment by boundary diffusion | 215 | 151 | 159 |

Example 13 and Comparative Example 13

Mother alloys in thin plate form were prepared by a strip casting technique, specifically by weighing Nd, Al, Fe and Cu metals having a purity of at least 99% by weight and ferroboron, high-frequency heating in an argon atmosphere for melting, and casting the alloy melt on a copper single roll. The mother alloys consisted of 17.0, 16.0, 15.0, 14.0, 13.0 or 12.0 atom % of Nd, 0.2 atom % of Al, 0.2 atom % of Cu, 6.0 atom % of B, and the balance of Fe. Hydriding pulverization was carried out by exposing each alloy to 0.11 MPa of hydrogen at room temperature to occlude hydrogen and then heating at 500° C. for partial dehydriding while evacuating to vacuum. The pulverized alloy was cooled and sieved, yielding a coarse powder under 50 mesh.

Subsequently, each of the coarse powders was finely pulverized on a Jet mill using high-pressure nitrogen gas into a fine powder having a mass median particle diameter of 5.1 to 5.8 μm. The fine powder was compacted under a pressure of about 100 MPa while being oriented in a magnetic field of 1.2 MA/m. The green compact was then placed in a sintering furnace with an argon atmosphere where it was sintered at 1,060° C. for 2 hours. In this way, there were obtained sintered magnet blocks which are designated M13-1, M13-2, M13-3, M13-4, P13-1, and P13-2 corresponding to the mother alloy's neodymium content of 17.0, 16.0, 15.0, 14.0, 13.0 or 12.0 atom %. The composition and the required minimum content ($R^1_{min}$) of blocks M13-1 to 4, P13-1 and 2 are shown in Table 16. It is seen that the Nd content in blocks M13-1 to 4 is greater than $R^1_{min}$ whereas the Nd content in blocks P13-1 and 2 is less than $R^1_{min}$.

Using a diamond grinding tool, each of magnet blocks M13-1 to 4, P13-1 and 2 was machined on all the surfaces into a magnet body having dimensions of 20×20×4.5 mm. It was washed in sequence with alkaline solution, deionized water, nitric acid and deionized water, and dried.

Subsequently, dysprosium fluoride and terbium boride ($TbB_4$) having an average particle size of 2.0 μm and 4.2 μm, respectively, were mixed in a weight ratio of 85:15 to form a powder mixture. It was mixed with propyl alcohol at a weight fraction of 50% to form a suspension, in which the magnet body was immersed for 30 seconds with ultrasonic waves being applied. The magnet body was pulled up and immediately dried with a hot air blow. At this point, the powder mixture surrounded the magnet body and occupied a magnet surface-surrounding space at a filling factor of 75% by volume.

The magnet body covered with the powder mixture was subjected to absorption treatment in an argon atmosphere at 800° C. for 15 hours. It was then subjected to aging treatment at 570° C. for one hour, and quenched. In this way, there were obtained magnets designated M13-1-A to M13-4-A, P13-1-A and P13-2-A. For evaluating an increase of coercive force by grain boundary diffusion treatment, magnets were prepared by subjecting similar magnet bodies to heat treatment in the absence of the powder mixture and aging treatment (i.e., without absorption treatment). They are designated magnets M13-1-B to M13-4-B and P13-1-B and P13-2-B. For these magnets, the coercive force and the increment of coercive force by grain boundary diffusion are shown in Table 16. It is seen that in magnets M13-1-A to M13-4-A having a Nd content in excess of $R^1_{min}$, the grain boundary diffusion treatment increased the coercive force by at least 342 kA/m. In magnets P13-1-A and P13-2-A having a Nd content below $R^1_{min}$, the grain boundary diffusion treatment increased the coercive force by only 72 or 8 kA/m.

TABLE 16

| | | Example 13 | | | | Comparative Example 13 | |
|---|---|---|---|---|---|---|---|
| | | M13-1 | M13-2 | M13-3 | M13-4 | P13-1 | P13-2 |
| Composition of original magnet (atom %) | $R^1$ | 16.22 | 15.14 | 14.13 | 13.10 | 12.16 | 11.21 |
| | T | 75.06 | 75.95 | 76.95 | 77.90 | 78.91 | 79.95 |
| | B | 5.87 | 5.87 | 5.87 | 5.86 | 5.87 | 5.87 |
| | M | 0.29 | 0.29 | 0.29 | 0.29 | 0.29 | 0.29 |
| | O | 0.65 | 0.63 | 0.67 | 0.64 | 0.65 | 0.68 |
| | C | 0.33 | 0.33 | 0.32 | 0.34 | 0.33 | 0.32 |
| | N | 0.11 | 0.12 | 0.12 | 0.13 | 0.12 | 0.11 |
| | $R^1_{min}$ | 12.58 | 12.58 | 12.60 | 12.60 | 12.59 | 12.60 |
| Coercive force (kA/m) | A (absorption treatment) | 1448 | 1448 | 1369 | 1241 | 828 | 700 |
| | B (no absorption treatment) | 1098 | 1082 | 1011 | 899 | 756 | 692 |
| | Increment by boundary diffusion | 350 | 366 | 358 | 342 | 72 | 8 |

Japanese Patent Application No. 2006-311352 is incorporated herein by reference.

Although some preferred embodiments have been described, many modifications and variations may be made thereto in light of the above teachings. It is therefore to be understood that the invention may be practiced otherwise than as specifically described without departing from the scope of the appended claims.

The invention claimed is:

1. A method for preparing a rare earth permanent magnet, comprising the steps of:

disposing a powder on a surface of a sintered magnet body of $R^1_aT_bB_cM_dO_eC_fN_g$ composition wherein $R^1$ is at least one element selected from rare earth elements inclusive of Sc and Y, T is at least one element selected from Fe and Co, M is at least one element selected from the group consisting of Al, Cu, Zn, In, Si, P, S, Ti, V, Cr, Mn, Ni, Ga, Ge, Zr, Nb, Mo, Pd, Ag, Cd, Sn, Sb, Hf, Ta, and W, and "a" to "g" indicative of atomic percent based on the alloy are in the range: $12 \leqq a \leqq 17$, $3 \leqq c \leqq 15$, $0.01 \leqq d \leqq 11$, $0.1 \leqq e \leqq 4$, $0.05 \leqq f \leqq 3$, $0.01 \leqq g \leqq 1$, and the balance of b, and $a \geqq 12.5+(e+f+g)\times 0.67-c\times 0.11$, said powder comprising at least one compound selected from among an oxide of $R^2$, a fluoride of $R^3$, and an oxyfluoride of $R^4$ wherein each of $R^2$, $R^3$, and $R^4$ is at least one element selected from rare earth elements inclusive of Sc and Y, and heat treating the magnet body having the powder disposed on its surface at a temperature equal to or below the sintering temperature of the magnet body in vacuum or in an inert gas for 1 minute to 100 hours, for causing at least one of $R^2$, $R^3$ and $R^4$ in the powder to be absorbed in the magnet body.

2. The method of claim 1 wherein the heat treatment of the magnet body is repeated at least two times.

3. The method of claim 1, further comprising, after the heat treatment, effecting aging treatment at a lower temperature.

4. The method of claim 1, wherein $R^1$ contains at least 10 atom % of Nd and/or Pr.

5. The method of claim 1, wherein T contains at least 50 atom % of Fe.

6. The method of claim 1, wherein said powder has an average particle size of up to 100 μm.

7. The method of claim 1, wherein $R^2$, $R^3$ and $R^4$ each contain at least 10 atom % of Dy and/or Tb.

8. The method of claim 1, wherein said powder comprises a fluoride of $R^3$ and/or an oxyfluoride of $R^4$, and the heat treatment causes fluorine to be absorbed in the magnet body along with $R^3$ and/or $R^4$.

9. The method of claim 8, wherein in said powder comprising a fluoride of $R^3$ and/or an oxyfluoride of $R^4$, $R^3$ and/or $R^4$ contains at least 10 atom % of Dy and/or Tb and has a lower total concentration of Nd and Pr than the total concentration of Nd and Pr in $R^1$.

10. The method of claim 8, wherein said powder comprising a fluoride of $R^3$ and/or an oxyfluoride of $R^4$ contains at least 10% by weight of a fluoride of $R^3$ and an oxyfluoride of $R^4$ combined and the balance of at least one compound selected from the group consisting of a carbide, nitride, boride, silicide, oxide, hydroxide, and hydride of $R^5$, and complex compounds comprising at least one of the foregoing wherein $R^5$ is at least one element selected from rare earth elements inclusive of Sc and Y.

11. The method of claim 1, wherein the disposing step includes feeding a slurry of said powder dispersed in an aqueous or organic solvent to the magnet body surface.

12. The method of claim 1, further comprising washing the magnet body with at least one agent selected from alkalis, acids, and organic solvents before the powder is disposed on the magnet body.

13. The method of claim 1, further comprising shot blasting the magnet body for removing a surface layer before the powder is disposed on the magnet body.

14. The method of claim 1, further comprising, after the heat treatment, subjecting the magnet body to machining, plating or painting.

* * * * *